US008334056B2

(12) United States Patent
Gleeson et al.

(10) Patent No.: US 8,334,056 B2
(45) Date of Patent: Dec. 18, 2012

(54) HIGH-TEMPERATURE COATINGS WITH PT METAL MODIFIED γ-NI + γ'-$NI_3$AL ALLOY COMPOSITIONS

(75) Inventors: Brian M. Gleeson, Sewickley, PA (US); Daniel J. Sordelet, Ames, IA (US); Wen Wang, Shenyan (CN)

(73) Assignee: Iowa State University Research Foundation, Inc., Ames, IA (US)

( * ) Notice: Subject to any disclaimer, the term of this patent is extended or adjusted under 35 U.S.C. 154(b) by 0 days.

(21) Appl. No.: 13/225,175

(22) Filed: Sep. 2, 2011

(65) Prior Publication Data

US 2011/0318604 A1 Dec. 29, 2011

Related U.S. Application Data

(63) Continuation of application No. 11/893,576, filed on Aug. 16, 2007, now abandoned, which is a continuation of application No. 10/439,649, filed on May 16, 2003, now Pat. No. 7,273,662.

(51) Int. Cl.
*B32B 15/04* (2006.01)
*F03B 3/12* (2006.01)

(52) U.S. Cl. ..... 428/680; 428/468; 428/629; 428/670; 428/926; 420/443; 420/444; 420/445; 420/455; 420/456; 420/460; 420/580; 148/426; 148/427; 148/428; 148/429; 148/442

(58) Field of Classification Search ..... None
See application file for complete search history.

(56) References Cited

U.S. PATENT DOCUMENTS 3,754,902 A 8/1973 Boone et al.
3,918,139 A 11/1975 Felten
3,933,483 A 1/1976 Komatsu et al.
3,976,436 A 8/1976 Chang
4,019,900 A 4/1977 Raghavan et al.
4,123,594 A 10/1978 Chang
4,123,595 A 10/1978 Chang
4,346,137 A * 8/1982 Hecht ..... 428/215
4,392,894 A 7/1983 Pearson et al.

(Continued)

FOREIGN PATENT DOCUMENTS

CA 1251059 3/1989

(Continued)

OTHER PUBLICATIONS

Leyens et al., "R&D Status and Needs for Improved EB-PVD Thermal Barrier Coating Performance," *Mat. Res. Soc. Symp. Proc.*, 2001, vol. 645E, pp. M10.1.1-M10.1.12.

(Continued)

*Primary Examiner* — Aaron Austin
(74) *Attorney, Agent, or Firm* — Shumaker & Sieffert, P.A.

(57) ABSTRACT

An alloy including:

about 10 at % to about 30 at % of a Pt-group metal;

less than about 23 at % Al;

about 0.5 at % to about 2 at % of at least one reactive element selected from Hf, Y, La, Ce and Zr, and combinations thereof;

a superalloy substrate constituent selected from the group consisting of Cr, Co, Mo, Ta, Re and combinations thereof;

and Ni;

wherein the Pt-group metal, Al, the reactive element and the superalloy substrate constituent are present in the alloy in a concentration to the extent that the alloy has a solely γ'-$Ni_3$Al phase constitution.

25 Claims, 18 Drawing Sheets

U.S. PATENT DOCUMENTS

| | | | | |
|---|---|---|---|---|
| 4,737,205 | A | | 4/1988 | Selman et al. |
| 4,743,514 | A | | 5/1988 | Strangman et al. |
| 4,758,480 | A | * | 7/1988 | Hecht et al. ..... 428/680 |
| 5,240,491 | A | | 8/1993 | Budinger et al. |
| 5,435,861 | A | | 7/1995 | Khan et al. |
| 5,514,482 | A | | 5/1996 | Strangman |
| 5,667,663 | A | | 9/1997 | Rickerby et al. |
| 5,763,107 | A | | 6/1998 | Rickerby et al. |
| 5,942,337 | A | | 8/1999 | Rickerby et al. |
| 5,981,091 | A | | 11/1999 | Rickerby et al. |
| 6,306,524 | B1 | | 10/2001 | Spitsberg et al. |
| 6,436,473 | B2 | | 8/2002 | Darolia et al. |
| 6,485,844 | B1 | | 11/2002 | Strangman et al. |
| 6,554,920 | B1 | | 4/2003 | Jackson et al. |
| 6,585,878 | B2 | | 7/2003 | Strangman et al. |
| 7,229,701 | B2 | | 6/2007 | Madhava et al. |
| 7,316,850 | B2 | | 1/2008 | Hu et al. |
| 7,531,217 | B2 | | 5/2009 | Gleeson et al. |
| 2002/0009611 | A1 | | 1/2002 | Darolia et al. |
| 2002/0132132 | A1 | | 9/2002 | Bose et al. |
| 2002/0187336 | A1 | | 12/2002 | Khan et al. |
| 2004/0229075 | A1 | | 11/2004 | Gleeson et al. |
| 2005/0003227 | A1 | | 1/2005 | Khan et al. |
| 2006/0093752 | A1 | | 5/2006 | Darolia et al. |
| 2006/0093801 | A1 | | 5/2006 | Darolia et al. |
| 2006/0093850 | A1 | | 5/2006 | Darolia et al. |
| 2006/0093851 | A1 | | 5/2006 | Darolia et al. |
| 2006/0127695 | A1 | | 6/2006 | Gleeson et al. |
| 2006/0210825 | A1 | | 9/2006 | Gleeson et al. |
| 2006/0292390 | A1 | | 12/2006 | Kassner et al. |
| 2007/0071995 | A1 | | 3/2007 | Hazel et al. |
| 2007/0071996 | A1 | | 3/2007 | Hazel et al. |

FOREIGN PATENT DOCUMENTS

| | | | |
|---|---|---|---|
| DE | 29 08 151 | | 10/1979 |
| EP | 0 652 299 | A1 | 5/1995 |
| EP | 0 718 420 | A1 | 6/1996 |
| EP | 1 111 192 | A1 | 6/2001 |
| EP | 1111091 | A1 | 6/2001 |
| EP | 1 321 541 | A2 | 6/2003 |
| EP | 1327702 | A1 | 7/2003 |
| GB | 2 029 857 | A | 3/1980 |
| JP | 58037144 | A | 3/1983 |
| JP | 58073761 | A | 5/1983 |
| JP | 04358037 | A | 12/1992 |
| JP | 05033091 | A | 2/1993 |
| JP | 07-247803 | | 9/1995 |
| JP | 08-225959 | | 9/1996 |
| JP | 2003-049231 | | 2/2003 |
| WO | WO 01/75192 | A2 | 10/2001 |
| WO | WO 2004/104243 | A2 | 12/2004 |
| WO | WO 2006/076130 | A2 | 7/2006 |
| WO | WO 2007/008227 | | 1/2007 |
| WO | WO 2007/008227 | A3 | 1/2007 |

OTHER PUBLICATIONS

Peters et al., "EB-PVD Thermal Barrier Coatings for Aeroengines and Gas Turbines," *Advanced Engineering Materials,* 2001, 3(4):193-204.

V.K. Tolpygo and D.R. Clarke, "Microstructural study of the theta-alpha transformation in alumina scales formed on nickel-aluminides," *Materials at High Temperatures,* vol. 17, No. 1, pp. 59-70 (2000).

J.A. Haynes, B.A. Pint, W.D. Porter and I.G. Wright, "Comparison of thermal expansion and oxidation behavior of various high-temperature coating materials and superalloys,"*Materials at High Temperatures,* vol. 21, No. 1, pp. 87-94 (2004).

PCT International Search Report and PCI Written Opinion from corresponding PCT Application No. PCT/US2004/014740, mailed Mar. 2, 2005 (9 pages).

The International Preliminary Report on Patentability from corresponding patent application No. PCT/US2004/01470, mailed Dec. 1, 2005, (7 pages).

Murakami et al., "Distribution of Platinum Group Metal in Ni-Base Single-Crystal Superalloys", Superalloys Proceedings International Symposium Superalloys, Sep. 17, 2000, pp. 747-756; XP009057026.

Reid et al., "Microstructural Transformations in Platinum Aiuminide Coated CMSX-4 Superalloy", Materials Science Forum vols. 461-464, pp. 343-350, (2004), XP009077214.

Goebel et al., "Interdiffusion between the platinum-modified aluminide coating RT 22 and nickel-based single-crystal superalloys at 1000 and 1200°C", Materials at High Temperatures. vol. 12, No. 4, pp. 301-309, (1994), XP009077277.

Chen et al., "Degradation of the platinum aluminide coating on CMSX4 at 1100°C", Surface & Coatings Technology, pp. 69-77, (1997), XP-002416853.

International Preliminary Examination Report from PCT Application Serial No. PCT/US05/029493, mailed Jun. 21, 2007, 7 pages.

International Preliminary Examination Report on Patentability for PCT Application Serial No. PCT/US05/045927 mailed Apr. 4, 2007 (28 pages).

PCT International Search Report and PCT Written Opinion from PCT Application No. PCT/US2005/029493, mailed Feb. 8, 2007, (12 pages).

PCT International Search Report and PCT Written Opinion from PCT Application No. PCT/US05/045927, mailed Jul. 19, 2007, (11 pages).

Communication pursuant to Article 96(2) EPC dated Jun. 11, 2007 for EP application No. 05 858 389.9 from the European Patent Office, (3 pages).

U.S. Appl. No. 11/744,633, filed May 4, 2007, (Continuation of U.S. Appl. No. 11/012,873).

U.S. Appl. No. 11/744,675, filed May 4, 2007, (Continuation of U.S. Appl. No. 10/439,649).

U.S. Appl. No. 11/744,622, filed May 4, 2007, (Continuation of U.S. Appl. No. 10/439,649).

U.S. Appl. No. 11/744,401, filed May 4, 2007, (Continuation of U.S. Appl. No. 10/439,649).

U.S. Appl. No. 11/744,634, filed May 4, 2007, (Continuation of U.S. Appl. No. 10/439,649).

U.S. Appl. No. 11/744,433, filed May 4, 2007, (Continuation of U.S. Appl. No. 11/206,663).

U.S. Appl. No. 11/744,453, filed May 4, 2007, (Continuation of U.S. Appl. No. 11/206,663).

U.S. Appl. No. 11/744,658, filed May 4, 2007, (Continuation of U.S. Appl. No. 11/206,663).

U.S. Appl. No. 11/744,653, filed May 4, 2007, (Continuation of U.S. Appl. No. 11/206,663).

Communication of a notice of opposition from the European Patent Office for EP patent No. 1784517 dated Nov. 10, 2009 (1 page).

The Opposition filed by Siemens AG with the European Patent Office dated Oct. 30, 2009 for EP patent No. 1784517 along with the English translation of the Opposition (17 Pages).

Office Action, dated Aug. 19, 2009, for Canadian application No. 2,597,898 from the Canadian Patent Office, (4 pages).

Translated Office Action for Mexican Patent Application No. MX/a/2007/007096, from the Mexican Patent Office, dated. Nov. 22, 2009, (3 pages).

Final Office Action dated Oct. 22, 2009 for U.S. Appl. No. 11/206,663, (19 pages).

First Office Action (Non-Final Notice of Reasons for Rejection) for Japanese application No. 2006-532957 dated Jan. 14, 2010 in Japanese with an English translation, (7 pages).

Office Action, dated Jan. 26, 2009, for counterpart Canadian application No. 2,525,320 from the Canadian Patent Office, (3 pages).

PCT Notification of Transmittal of the International Search Report and Written Opinion of the International Searching Authority, or the Declaration from PCT Application No. PCT/US2009/052415, mailed Mar. 2, 2010 (14 pages).

Office Action dated Jan. 28, 2009 for U.S. Appl. No. 11/206,663, (20 pages).

Office Action for Australian Patent Application No. 2005324336, from IP Australia, dated Dec. 19, 2008, (2 pages).

Office Action dated Mar. 19, 2008, for U.S. Appl. No. 11/206,663, (27 pages).

Communication pursuant to Article 96(2) EPC, dated Jan. 17, 2008, for EP application No. 05 858 389.9 from the European Patent Office, (3 pages).

N. Violas and D. Monceau, "Effect of Pt and Al content on the long-term, high temperature oxidation behavior and interdiffusion of a Pt-modified aluminide coating deposited on Ni-base superalloys", Surface & Coatings Technology, 201, (2006) pp. 3846-3851.
S. Hayashi et al., "Interdiffusion Behavior of Pt-Modified γ-Ni + γ'-$Ni_3Al$ Alloys Coupled to Ni-A1-Based Alloys", Metallurgical and Materials Transactions A, vol. 36A Jul. 2005, pp. 1769-1775.
Office Action dated Jun. 25, 2008 for U.S. Appl. No. 11/012,873, (9 pages).
Japanese Office Action (in Japanese) dated Jun. 30, 2009 and Appendix translated into English for Japanese patent application No. 2007-547002, (6 pages).
Office Action dated Sep. 7, 2007 for U.S. Appl. No. 11/012,873, (15 pages).
Peggy Y. Hou "Impurity Effects on Alumina Scale Growth", Journal of Am. Ceram. Soc., vol. 86, No. 4, 2003, pp. 660-668.
B. A. Pint et al., "Grain Boundary Segregation of Cation Dopants in α-$Al_2O_3$ Scales", Journal of Electrochem. Soc., vol. 145, No. 6, Jun. 1998, pp. 1819-1829.
Tresa M. Pollock et al., "Nickel-Based Superalloys for Advanced Turbine Engines: Chemistry, Microstructure, and Properties", Journal of Propulsion and Power, vol. 22, No. 2, Mar.-Apr. 2006, pp. 361-377.
Roger C. Reed, "The Superalloys Fundamentals and Applications", Cambridge University Press, 2006, (7 pages).
Office Action dated Sep. 12, 2008, for U.S. Appl. No. 11/206,663, (20 pages).
Wright et at., "Mechanisms governing the performance of thermal barrier coating," Current Opinion in Solid State and Materials Science, vio. 4, 1999, pp. 255-265.
Office Action from U.S. Appl. No. 12/173,683, dated Oct. 14, 2010, 29 pp.
U.S. Appl. No. 12/173,683, filed Jul. 15, 2008, entitled "Pt Metal Modified γ-Ni + γ'-$Ni_3Al$ Alloy Compositions for High Temperature Degradation Resistant Structural Alloys".
U.S. Appl. No. 12/183,709, filed Jul. 31, 2008, entitled "γ-$Ni_3Al$ Matrix Phase Ni-Based Alloy and Coating Compositions Modified by Reactive Element Co-Additions and Si".
Office Action from U.S. Appl. No. 11/206,663, dated Apr. 27, 2010, 19 pp.
Office Action from U.S. Appl. No. 11/206,663, dated Nov. 24, 2010, 17 pp.
Examination Report from corresponding European patent application No. 04751906.1, dated Dec. 1, 2010, 4 pp.
Official Action from the Japanese Patent Office in Japanese and it's English translation, dated May 19, 2011, from counterpart Japanese application No. 2006-532957, 5 pp.
Office Action from U.S. Appl. No. 13/032,668, dated Aug. 19, 2011, 22 pp.
Office Action from U.S. Appl. No. 13/032,700, dated Dec. 21, 2011, 31 pp.
U.S. Appl. No. 13/226,835, by Brian Gleeson, filed Sep. 7, 2011.
U.S. Appl. No. 13/226,916, by Brian Gleeson, filed Sep. 7, 2011.

* cited by examiner

Weight change of Ni-Al-Pt alloys of different phase constitutions after "isothermal" exposure at 1150°C in still air. Also included for comparison is binary β-NiAl of stoichiometric composition.

β-NiAl (50Al/50Ni)

β-NiAl(Pt) (50Al/35Ni/15Pt)

β-NiAl + $PtAl_2$ (48Al/26Ni/26Pt)

γ-Ni + γ'-$Ni_3Al$ (22Al/48Ni/30Pt)

Cross-sectional images of selected alloys shown in Fig. 6 after 100 h oxidation at 1150°C in air. The compositions are nominal and in atom percent.

Ni-22Al-30Pt

Ni-22Al-25Pt

Ni-22Al-30Pt-0.5Hf

Cross-sectional images of selected γ' + γ alloys after 1000 h isothermal oxidation at 1150°C in air. All images are the same magnification (x500). The compositions are nominal and in atom percent.

Cross-sectional Images of $\gamma' + \gamma$ Alloys After Isothermal Oxidation at 1150°C in Air

#B3: Ni-22Al (60h)

#27: Ni-22Al-20Pt (500h)

#42: Ni-22Al-10Pt (500h)

#7: Ni-22Al-30Pt (500h)

Comparison of the cyclic oxidation kinetics of Pt-modified β-NiAl, Pt-modified γ'-$Ni_3Al$+γ-Ni, and Pt modified γ'-$Ni_3Al$+γ-N with Hf at 1150°C in air.

Surface and Cross-Sectional Images After 1000 Cycles Oxidation at 1150° C in Air Ni-22Al-30Pt Ni-22Al-30Pt-1wt%Hf Surface and Cross-Sectional Images After 1000 h Isothermal Oxidation at 1150°C in Air
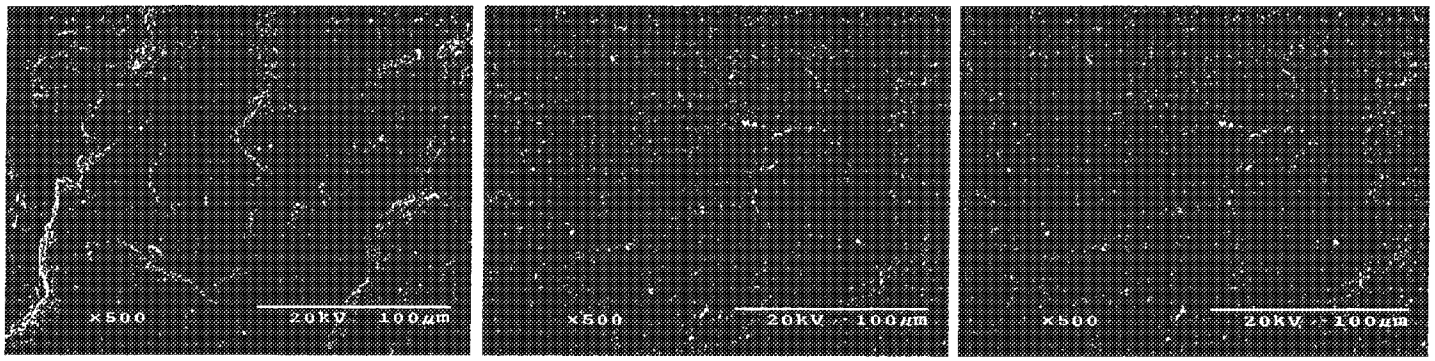
FIG. 17A FIG. 17C FIG. 17E
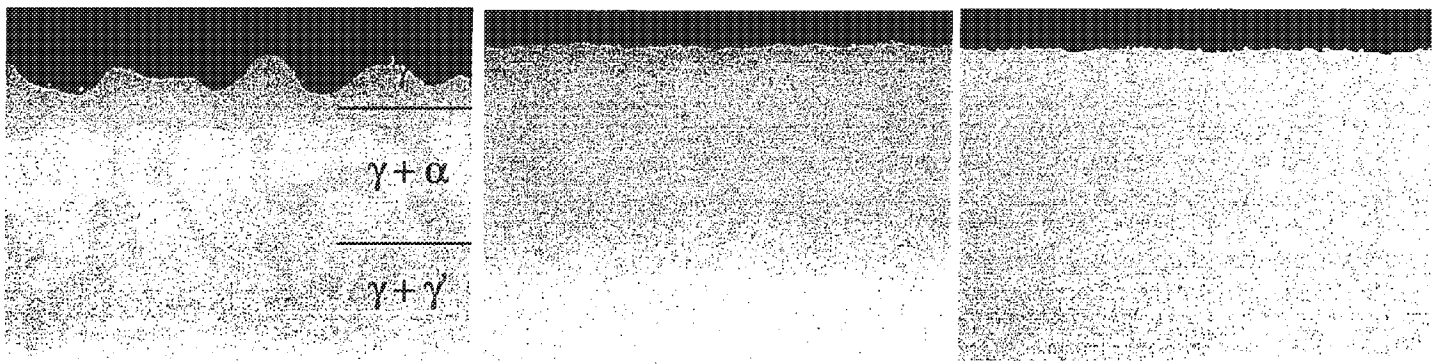
FIG. 17B Alloy 7 (Ni-22Al-30Pt)
FIG. 17D Alloy 32 (#7 + 1wt%Hf)
FIG. 17F Alloy 36 (#7 + 2wt%Hf))

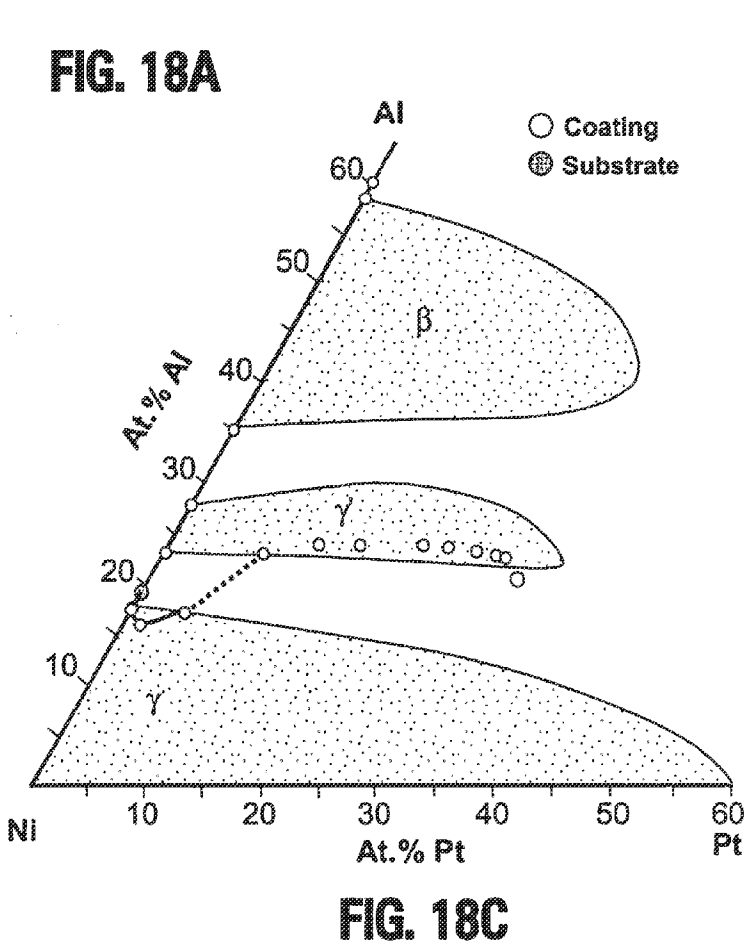
FIG. 18A
FIG. 18C
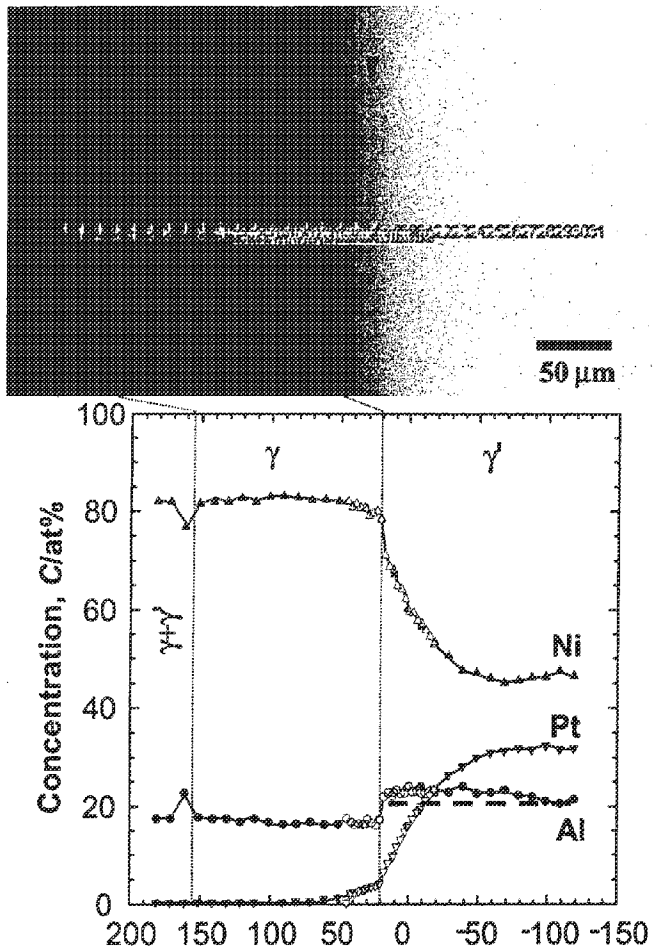
FIG. 18B
Microstructure and composition profiles through a γ'+γ (Ni-22Al-30Pt) / γ'+γ (Ni-22Al) couple after 50 h interdiffusion at 1150°C, Microstructure and composition profiles through a γ'+γ (Ni-22Al-30Pt)/CMSX-4 couple after 50 h interdiffusion at 1150°C. The aluminum profile shows that there was Al-enrichment in the γ'+γ side of the couple, i.e., there was uphill diffusion of aluminum.

HIGH-TEMPERATURE COATINGS WITH PT METAL MODIFIED γ-NI + γ'-$NI_3$AL ALLOY COMPOSITIONS

This application is a continuation of application Ser. No. 11/893,576, filed Aug. 16, 2007, entitled, "HIGH TEMPERATURE COATINGS WITH Pt METAL MODIFIED γ-Ni+γ'-$Ni_3$Al ALLOY COMPOSITIONS", which is a continuation of U.S. patent application Ser. No. 10/439,649, filed May 16, 2003 (issued as U.S. Pat. No. 7,273,662 on Sep. 25, 2007), entitled, "HIGH TEMPERATURE COATINGS WITH Pt METAL MODIFIED γ-Ni+γ'-$Ni_3$Al ALLOY COMPOSITIONS", which are hereby incorporated by reference in their entirety.

STATEMENT REGARDING FEDERALLY SPONSORED RESEARCH AND DEVELOPMENT

The U.S. Government has a paid-up license in this invention and the right in limited circumstances to require the patent owner to license others on reasonable terms as provided by the terms of Contract Nos. N00014-00-1-0484 and N00014-02-1-0733, each awarded by the Office of Naval Research.

TECHNICAL FIELD

This invention relates to alloy compositions for high-temperature, oxidation resistant coatings. Coatings based on these alloy compositions may be used, for example, as part of a thermal barrier system for components in high-temperature systems.

BACKGROUND

The components of high-temperature mechanical systems, such as, for example, gas-turbine engines, must operate in severe environments. For example, the high-pressure turbine blades and vanes exposed to hot gases in commercial aeronautical engines typically experience metal surface temperatures of about 1000° C., with short-term peaks as high as 1100° C. A portion of a typical metallic article 10 used in a high-temperature mechanical system is shown in FIG. 1. The blade 10 includes a Ni or Co-based superalloy substrate 12 coated with a thermal barrier coating (TBC) 14. The thermal barrier coating 14 includes a thermally insulative ceramic topcoat 20 and an underlying metallic bond coat 16. The topcoat 20, usually applied either by air plasma spraying or electron beam physical vapor deposition, is most often a layer of yttria-stabilized zirconia (YSZ) with a thickness of about 300-600 μm. The properties of YSZ include low thermal conductivity, high oxygen permeability, and a relatively high coefficient of thermal expansion. The YSZ topcoat 20 is also made "strain tolerant" by depositing a structure that contains numerous pores and/or pathways. The consequently high oxygen permeability of the YSZ topcoat 20 imposes the constraint that the metallic bond coat 16 must be resistant to oxidation attack. The bond coat 16 is therefore sufficiently rich in Al to form a layer 18 of a protective thermally grown oxide (TGO) scale of α-$Al_2O_3$. In addition to imparting oxidation resistance, the TGO bonds the ceramic topcoat 20 to the substrate 12 and bond coat 16. Notwithstanding the thermal protection provided by the thermal barrier coating 14, the spallation and cracking of the thickening TGO scale layer 18 is the ultimate failure mechanism of commercial TBCs. Thus, improving the adhesion and integrity of the interfacial TGO scale 18 is critical to the development of more reliable TBCs.

Related to this is the need to significantly reduce the progressive roughening or "rumpling" of the bond coat surface during thermal exposure, which is a formidable limitation of conventional bond coat systems.

The adhesion and mechanical integrity of the TGO scale layer 18 is very dependent on the composition and structure of the bond coat 16. Ideally, when exposed to high temperatures, the bond coat 16 should oxidize to form a slow-growing, non-porous TGO scale that adheres well to the superalloy substrate 12. Conventional bond coats 16 are typically either an MCrAlY overlay (where M=Ni, Co, NiCo, or Fe) or a platinum-modified diffusion aluminide (β-NiAl—Pt). The Al content in these coatings is sufficiently high that the $Al_2O_3$ scale layer 18 can "re-heal" following repeated spalling during service of the turbine component.

However, the adhesion, and therefore the reliability, of the TBC system is measured with respect to the first spallation event of the TGO scale layer 18. As a result, once the first spallation event occurs in the scale layer 18, the ceramic topcoat 20 can begin to delaminate and fail, so that re-healing of the scale layer 18 is not a critically important performance requirement for the adhesion of the ceramic topcoat 20. Thus, conventional bond coats, which were designed primarily for re-healing the $Al_2O_3$ TGO scale layer, do not necessarily possess the optimum compositions and/or phase constitutions to provide enhanced scale layer adhesion and improved TBC reliability.

Another approach to improving the adhesion of the TGO scale layer on a second metallic article 28 is shown in FIG. 2A. A superalloy substrate 30 is coated on an outer surface with a layer 32 of Pt and then heat-treated. Referring to FIG. 2B, following this heat treatment Al diffuses from the superalloy substrate 30 into the Pt layer 32 to form a surface-modified outer region 34 on the superalloy substrate (FIG. 2B). An $Al_2O_3$ TGO scale layer 38 and a ceramic layer topcoat 40 may then be formed on the surface modified region 34 using conventional techniques. However, since transition metals from the superalloy substrate 30 are also present in the surface modified region 34, it is difficult to precisely control the composition and phase constitution of the surface region 34 to provide optimum properties to improve adhesion of the TGO scale layer 38.

Future improvements in gas-turbine performance will require even higher operating efficiencies, longer operating lifetimes, reduced emissions and, therefore, higher turbine operating temperatures. Improved TBCs are needed to protect turbine operating components at increased temperatures (e.g. 1150° C.), and new bond coat compositions must be developed to reduce spallation and increase adhesion of the TGO layer, which will result in an enhanced reliability for the ceramic topcoat layer.

SUMMARY

As noted above, conventional β-NiAl—Pt bond coats have a relatively high Al content to promote healing of the $Al_2O_3$ TGO scale layer following spallation. As a result of this Al enriched composition and the predominance of the γ-NiAl phase constitution of the base alloy in the coating microstructure, these bond coats are not compatible with the phase constitution of the Ni-based superalloy substrates, which have a γ-Ni+γ'-$Ni_3$Al microstructure. When applied to a superalloy substrate having a γ-Ni+γ'-$Ni_3$Al phase structure, since the β-NiAl—Pt alloys have a significantly higher Al concentration, Al diffuses from the bond coat layer to the substrate at the interface between the adjacent layers. This Al interdiffusion depletes Al in the bond coat layer, which reduces the ability of the coating to sustain $Al_2O_3$ scale growth. Additional diffusion also introduces unwanted elements that can promote oxide scale spallation. A further consequence of coating/substrate interdiffusion, particularly for the next generation of superalloys containing up to 6 wt % rhenium, is the formation of brittle and hence deleterious topologically-closed-pack (TCP) phases, such as σ, in the region of the original coating/substrate interface. This TCP phase formation detrimentally affects the mechanical properties and can greatly shorten the useful service life of the coated component.

In one aspect, the invention is an alloy including a Pt-group metal, Ni and Al in relative concentration to provide a γ+γ' phase constitution. In this application γ refers to the solid-solution Ni phase and γ' refers to the solid-solution $Ni_3Al$ phase.

In another aspect, the invention is an alloy including a Pt-group metal, Ni and Al, wherein the concentration of Al is limited with respect to the concentrations of Ni and the Pt-group metal such that the alloy includes substantially no β-NiAl phase.

In yet another aspect, the invention is a ternary Ni—Al—Pt alloy including less than about 23 at % Al, about 10 at % to about 30 at % of a Pt-group metal, and the remainder Ni.

In yet another aspect, the invention is an alloy including Ni, Al and Pt as defined in the region A in FIG. 3.

In yet another aspect, the invention is a coating composition including a Pt-group metal, Ni and Al, wherein the composition has a γ-Ni+γ'-$Ni_3Al$ phase constitution. The composition may further include a reactive element such as Hf in sufficient concentration to provide one of a γ+γ' or γ' phase constitution.

In yet another aspect, the invention is a thermal barrier coated article including (a) a superalloy substrate; and (b) a bond coat on the substrate, wherein the bond coat includes a Pt-group metal, Ni and Al, and wherein the bond coat has a γ-Ni+γ'-$Ni_3Al$ phase constitution. The bond coat may further include a reactive element such as Hf in sufficient concentration to provide one of a γ+γ' or γ' phase constitution.

In yet another aspect, the invention is a method for making a heat-resistant substrate including applying on the substrate a coating including Ni and Al in a γ-Ni+γ'-$Ni_3Al$ phase constitution. The coating may further include a reactive element such as Hf in sufficient concentration to provide one of a γ+γ' or γ' phase constitution.

In yet another aspect, the invention is a thermal barrier coated article including a superalloy substrate; a bond coat on the substrate, wherein the bond coat includes a ternary alloy of Pt—Ni—Al, and wherein the alloy has a γ-Ni+γ'-$Ni_3Al$ phase constitution; an adherent layer of oxide on the bond coat; and a ceramic coating on the adherent layer of oxide.

In yet another aspect, the invention is a method for reducing oxidation in γ-Ni+γ'-$Ni_3Al$ alloys, including adding a Pt-group metal and an optional a reactive element to the alloys.

In yet another aspect, the invention is a homogeneous coating including an alloy with a γ-Ni+γ'-$Ni_3Al$ phase constitution.

The Pt-group metal modified alloys of the present invention have a gamma-Ni phase and a gamma prime-$Ni_3Al$ (referred to herein as γ-Ni+γ'-$Ni_3Al$ or γ+γ') phase constitution that is both chemically and mechanically compatible with the γ+γ' microstructure of a typical Ni-based superalloy substrate. The Pt-group metal modified γ+γ' alloys are particularly useful in bond coat layers applied on a superalloy substrate used in a high-temperature resistant mechanical components.

The details of one or more embodiments of the invention are set forth in the accompanying drawings and the description below. Other features, objects, and advantages of the invention will be apparent from the description and drawings, and from the claims.

DESCRIPTION OF DRAWINGS

FIG. 17 is a series of surface and cross-sectional images illustrating the effect of Hf modification on selected Pt-modified β-NiAl, γNi+γ'-$Ni_3Al$ alloys of Example 1 and FIG. 16.

FIG. 18 is an illustration of microstructure and composition profiles through a γ-Ni+γ'-$Ni_3Al$ alloy composition (Ni-22Al-30Pt)/γ-Ni+γ'-$Ni_3Al$ (Ni-22Al) couple after 50 h interdiffusion at 1150° C.

Like reference symbols in the various drawings indicate like elements.

DETAILED DESCRIPTION

In one aspect, the invention is a platinum (Pt) group metal modified γ-Ni+γ'-$Ni_3Al$ alloy, which in this application refers to an alloy including a Pt-group metal, Ni and Al in relative concentration such that a γ-Ni+γ'-$Ni_3Al$ phase constitution results. In this alloy the concentration of Al is limited with respect to the concentration of Ni and the Pt-group metal such that substantially no β-NiAl phase structure, preferably no β-NiAl phase structure, is present in the alloy, and the γ-Ni+γ'-$Ni_3Al$ phase structure predominates.

The Pt-group metal may be selected from, for example, Pt, Pd, Ir, Rh and Ru, or combinations thereof. Pt-group metals including Pt are preferred, and Pt is particularly preferred.

In the alloy Al is preferably present at less than about 23 at %, preferably about 10 at % to about 22 at % (3 wt % to 9 wt %), the Pt-group metal is present at about 10 at % to about 30 at % (12 wt % to 63 wt %), preferably about 15 at % to about 30 at %, with the remainder Ni. The at % values specified for all elements in this application are nominal, and may vary by as much as ±1-2 at %.

Additional reactive elements such as Hf, Y, La, Ce and Zr, or combinations thereof, may optionally be added to or present in the ternary Pt-group metal modified γ-Ni+γ'-$Ni_3Al$ alloy to modify and/or improve its properties. The addition of such reactive elements tends to stabilize the γ' phase. Therefore, if sufficient reactive metal is added to the composition, the resulting phase constitution may be predominately γ' or solely γ'. The Pt-group metal modified γ-Ni+γ'-$Ni_3Al$ alloy exhibits excellent solubility for reactive elements compared to conventional β-NiAl—Pt alloys, and typically the reactive elements may be added to the γ+γ' alloy at a concentration of up to about 2 at % (4 wt %), preferably 0.3 at % to 2 at % (0.5 wt % to 4 wt %), more preferably 0.5 at % to 1 at % (1 wt % to 2 wt %). A preferred reactive element includes Hf, and Hf is particularly preferred.

In addition, other typical superalloy substrate constituents such as, for example, Cr, Co, Mo, Ta, and Re, and combinations thereof, may optionally be added to or present in the Pt-group metal modified γ-Ni+γ'-$Ni_3Al$ alloy in any concentration to the extent that a γ+γ' phase constitution predominates.

Figure 1:
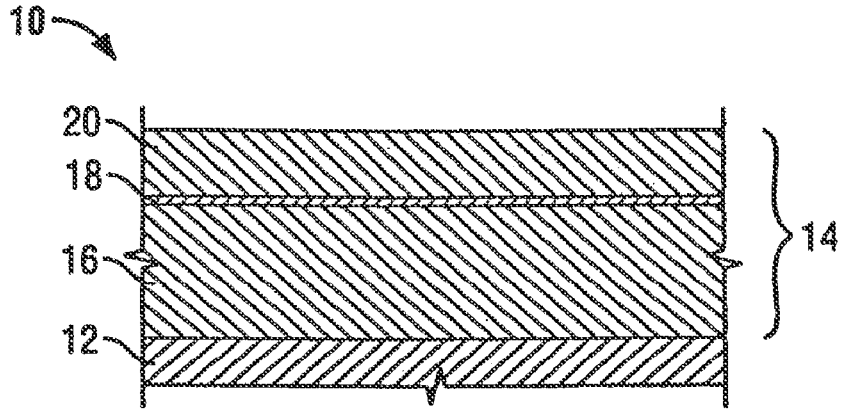
FIG. 1 is a cross-sectional diagram of a metallic article with a thermal barrier coating.
Figure 2A:
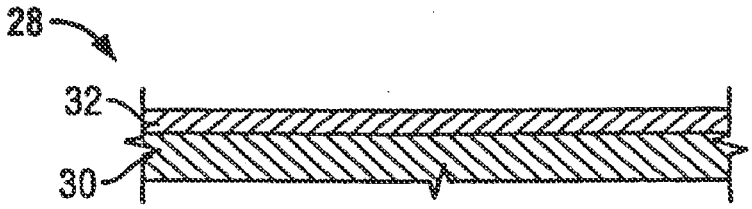
FIG. 2A is a cross-sectional diagram of a metallic article coated with a Pt layer, prior to heat treatment.
Figure 2B:
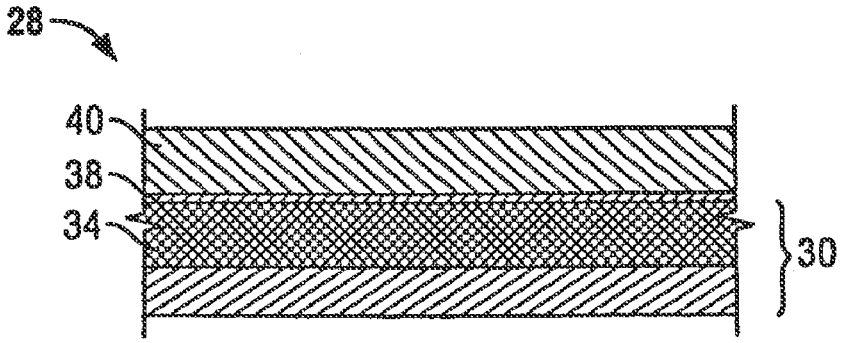
FIG. 2B is a cross-sectional diagram of the metallic article of FIG. 2A following heat treatment of the superalloy substrate and application of a conventional thermal barrier coating.
Figure 3:
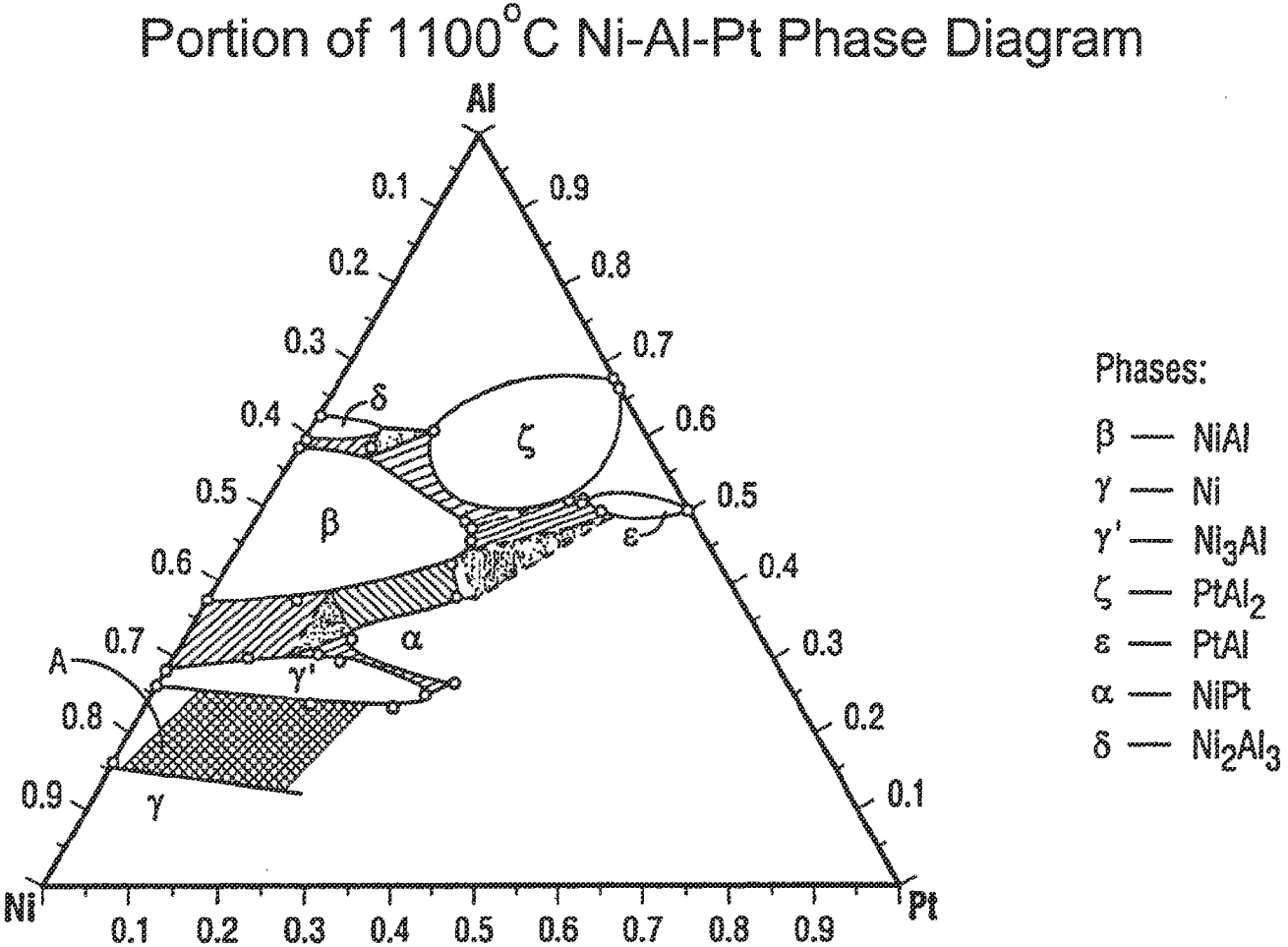
FIG. 3 is a portion of a 1100° C. Ni—Al—Pt phase diagram showing an embodiment of the Pt metal modified γ-Ni+γ'-$Ni_3Al$ alloy compositions of the invention.

Referring to FIG. 3, a portion of a phase diagram of an embodiment of the invention is shown in which the Pt-group metal is Pt. In this embodiment the Ni—Al—Pt phase diagram includes phases β-NiAl (region (β), γ-Ni (region γ) and γ'-$Ni_3Al$ (region γ'). In this embodiment, if the Al concentration is selected with respect to the concentration of Ni and Pt such that the ternary alloy falls within the shaded region A falling between the γ-Ni and the γ'-$Ni_3Al$ phase fields, then the components are present in a γ+γ' structure.

In the embodiment depicted in the region A of FIG. 3, Al is preferably present at less than about 23 at %, preferably about 10 at % to about 22 at % (3 wt % to 9 wt %) and Pt is present at about 10 at % to about 30 at % (12 wt % to 63 wt %), preferably about 15 at % to about 30 at %, with the remainder Ni. An optional reactive element such as Hf, if present, may be added at a concentration of about 0.3 at % to about 2 at % (0.5 wt % to 4 wt %).

The alloys may be prepared by conventional techniques such as, for example, argon-arc melting pieces of high-purity Ni, Al, Pt-group metals and optional reactive and/or superalloy metals and combinations thereof.

Figure 4:
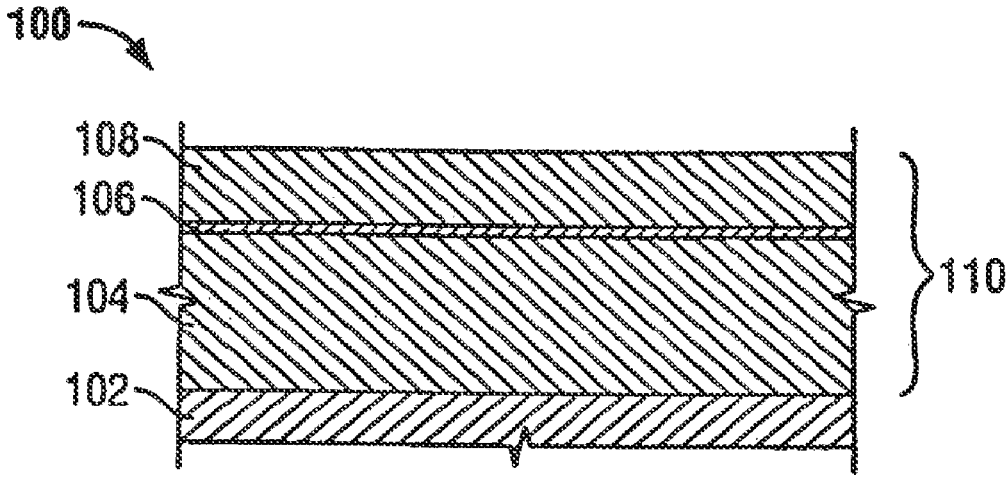
FIG. 4 is a cross-sectional diagram of a metallic article with a thermal barrier coating.

The Pt-group metal modified γ-Ni+γ'-$Ni_3Al$ alloy may be applied on a substrate to impart high-temperature degradation resistance to the substrate. Referring to FIG. 4, a typical substrate will typically be a Ni or Co-based superalloy substrate 102. Any conventional Ni or Co-based superalloy may be used as the substrate 102, including, for example, those available from Martin-Marietta Corp., Bethesda, Md., under the trade designation MAR-M 002; those available from Cannon-Muskegon Corp., Muskegon, Mich., under the trade designation CMSX-4, CMSX-10, and the like.

The Pt-group metal modified γ-Ni+γ'-$Ni_3Al$ alloy may be applied to the substrate 102 using any known process, including for example, plasma spraying, chemical vapor deposition (CVD), physical vapor deposition (PVD) and sputtering to create a coating 104 and form a temperature-resistant article 100. Typically this deposition step is performed in an evacuated chamber.

The thickness of the coating 104 may vary widely depending on the intended application, but typically will be about 5 μm to about 100 μm, preferably about 5 μm to about 50 μm, and most preferably about 10 μm to about 50 μm. The composition of the coating 104 may be precisely controlled, and the coating has a substantially homogenous γ+γ' constitution, which in this application means that the γ+γ' structure predominates though the entire thickness of the coating. In addition, the coating 104 has a substantially constant Pt-group metal concentration throughout its entire thickness.

If the coating 104 is a bond coat layer, a layer of ceramic typically consisting of partially stabilized zirconia may then be applied using conventional PVD processes on the bond coat layer 104 to form a ceramic topcoat 108. Suitable ceramic topcoats are available from, for example, Chromalloy Gas Turbine Corp., Delaware, USA. The deposition of the ceramic topcoat layer 108 conventionally takes place in an atmosphere including oxygen and inert gases such as argon. The presence of oxygen during the ceramic deposition process makes it inevitable that a thin oxide scale layer 106 is formed on the surface of the bond coat 104. The thermally grown oxide (TGO) layer 106 includes alumina and is typically an adherent layer of α-$Al_2O_3$. The bond coat layer 104, the TGO layer 106 and the ceramic topcoat layer 108 form a thermal barrier coating 110 on the superalloy substrate 102.

The Pt-group metal modified γ-Ni+γ'-$Ni_3Al$ alloys utilized in the bond coat layer 104 are both chemically and mechanically compatible with the γ+γ' phase constitution of the Ni or Co-based superalloy 102. Protective bond coats formulated from these alloys will have coefficients of thermal expansion (CTE) that are more compatible with the CTEs of Ni-based superalloys than the CTEs of β-NiAl—Pt based alloy bond coats. The former provides enhanced thermal barrier coating stability during the repeated and severe thermal cycles experienced by mechanical components in high-temperature mechanical systems.

When thermally oxidized, the Pt-group metal modified γ-Ni+γ'-$Ni_3Al$ alloy bond coats grow an α-$Al_2O_3$ scale layer at a rate comparable to or slower than the thermally grown scale layers produced by conventional β-NiAl—Pt bond coat systems, and this provides excellent oxidation resistance for γ-Ni+γ'-$Ni_3Al$ alloy compositions. The Pt-metal modified γ+γ' alloys also exhibit much higher solubility for reactive elements such as, for example, Hf, than conventional β-NiAl—Pt alloys, which makes it possible to further tailor the alloy formulation for a particular application. For example, when the Pt-metal modified γ+γ' alloys are formulated with other reactive elements such as, for example, Hf, and applied on a superalloy substrate as a bond coat, the growth of the TGO scale layer is even slower. After prolonged thermal exposure, the TGO scale layer further appears more planar and has enhanced adhesion on the bond coat layer compared to scale layers formed from conventional β-NiAl—Pt bond coat materials.

In addition, the thermodynamic activity of Al in the Pt-group metal modified γ-Ni+γ'-$Ni_3Al$ alloys can, with sufficient Pt content, decrease to a level below that of the Al in Ni-based superalloy substrates. When such a bond coating including the Pt-group metal modified γ-Ni+γ'-$Ni_3Al$ alloys is applied on a superalloy substrate, this variation in thermodynamic activity causes Al to diffuse up its concentration gradient from the superalloy substrate into the coating. Such "uphill diffusion" reduces and/or substantially eliminates Al depletion from the coating. This reduces spallation in the scale layer, increases the stability of the scale layer, and enhances the service life of the ceramic topcoat in the thermal barrier system.

Thermal barrier coatings with bond coats including the Pt-group metal modified γ-Ni+γ'-$Ni_3Al$ alloys may be applied to any metallic part to provide resistance to severe thermal conditions. Suitable metallic parts include Ni and Co based superalloy components for gas turbines, particularly those used in aeronautical and marine engine applications.

EXAMPLES

Example 1

Ni—Al—Pt alloys and Ni—Al—Pt alloys modified with Hf were prepared by argon-arc melting pieces of high-purity Ni, Al, Pt, and Hf. To ensure homogenization and equilibrium, all alloys were annealed at 1100° C. or 1150° C. for 1 week in a flowing argon atmosphere and then quenched in water to retain the high-temperature structure. The alloys were cut into coupon samples and polished to a 600-grit finish for the further testing on phase equilibrium, oxidation, and interdiffusion.

The equilibrated samples were first analyzed using X-ray diffraction (XRD) for phase identification and then prepared for metallographic analyses by cold mounting them in an epoxy resin followed by polishing to a 0.5 μm finish. Microstructure observations were initially carried out on etched samples using an optical microscope. Concentration profiles were obtained from un-etched (i.e., re-polished) samples by either energy (EDS) or wavelength (WDS) dispersive spectrometry, with the former utilizing a secondary electron microscope (SEM) and the latter an electron probe microanalyzer (EPMA). Differential thermal analysis (DTA) was also conducted on selected samples to determine thermal stability of different phases.

The identified alloy compositions are shown in Table 1:

TABLE 1

| | | Overall Comp. | | | Phases Comp. γ'-$Ni_3Al$ | | | Phases Comp. γ-Ni | | |
|---|---|---|---|---|---|---|---|---|---|---|
| Alloy | | Ni | Al | Pt | Ni | Al | Pt | Ni | Al | Pt |
| 7 | at. % | 48 | 22 | 30 | 47.6 | 21.9 | 30.5 | 63.6 | 13.3 | 23.1 |
| | wt. % | 30.4 | 6.4 | 63.2 | 29.9 | 6.3 | 63.8 | 43.4 | 4.2 | 52.4 |

TABLE 1-continued

| | | Overall Comp. | | | Phases Comp. γ'-$Ni_3Al$ | | | Phases Comp. γ-Ni | | |
|---|---|---|---|---|---|---|---|---|---|---|
| Alloy | | Ni | Al | Pt | Ni | Al | Pt | Ni | Al | Pt |
| 27 | at. % | 58 | 22 | 20 | 57.4 | 21.5 | 21.1 | 69.5 | 14.6 | 15.9 |
| | wt. % | 43.1 | 7.5 | 49.4 | 41.8 | 7.2 | 51.0 | 53.9 | 5.2 | 40.9 |
| 28 | at. % | 53 | 22 | 25 | 52.8 | 22.1 | 25.1 | 66.6 | 14.1 | 19.3 |
| | wt. % | 36.3 | 6.9 | 56.8 | 36.1 | 6.9 | 57.0 | 48.5 | 4.7 | 46.8 |
| 29 | at. % | 64 | 16 | 20 | 55.2 | 20.5 | 24.3 | 67.3 | 13.7 | 19.0 |
| | wt. % | 46.5 | 5.3 | 48.2 | 38.0 | 6.5 | 55.5 | 49.2 | 4.6 | 46.2 |
| 42 | at. % | 68 | 22 | 10 | — | — | — | — | — | — |
| | wt. % | 61.1 | 9.1 | 29.8 | — | — | — | — | — | — |

Figure 5:
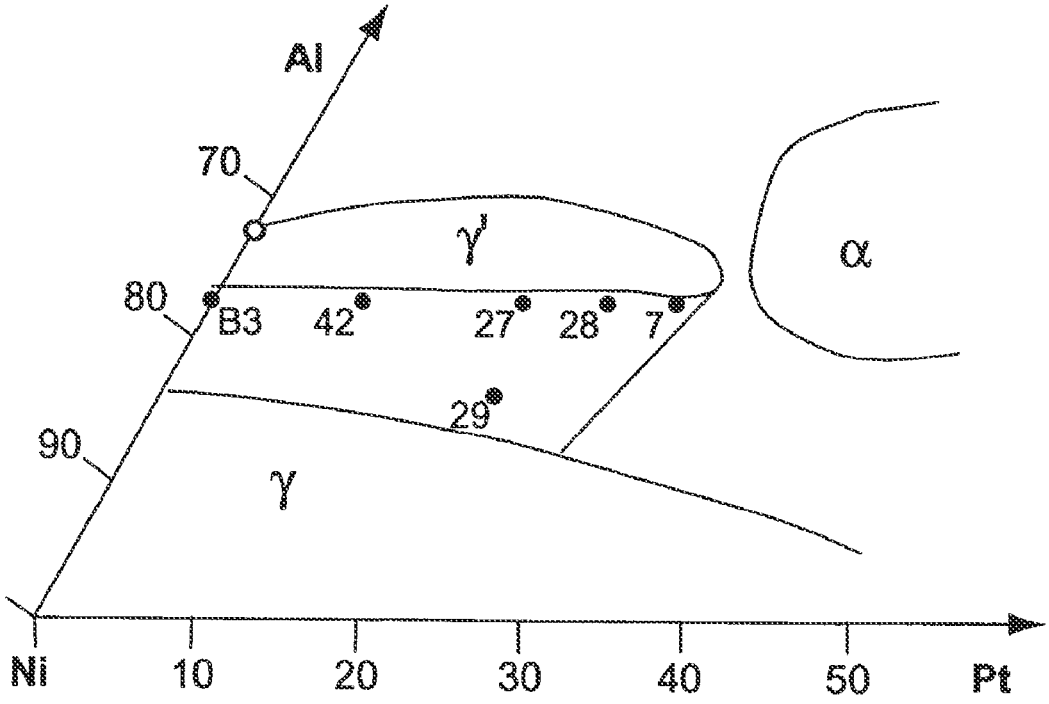
FIG. 5 is a portion of a Ni—Al—Pt phase diagram showing the alloy compositions of Example 1.

The identified alloy compositions are also depicted on a Ni-rich portion of the NiAlPt phase diagram shown in FIG. 5. From this portion of the phase diagram it is evident that alloys 7, 27, 28, 32 and 42 are composed primarily of the γ' phase, while alloys 29 and 38 are primarily of the γ phase.

Example 2

Isothermal and Cyclic Oxidation

Isothermal and cyclic oxidation tests were carried out at 1100 and 1150° C. in still air using a vertical furnace. Isothermal oxidation kinetics were monitored by intermittently cooling the samples to room temperature and then measuring sample weight change using an analytical balance. No attempt was made to retain any scale that may have spalled during cooling to room temperature or handling. As a consequence, weight-loss kinetics were sometimes observed. Cyclic oxidation testing involved repeated thermal cycles of one hour at temperature (1100 or 1150° C.) followed by cooling and holding at about 120° C. for 15 minutes. Sample weight change was measured periodically during the cool-down period. Raising and lowering the vertical furnace via a timer-controlled, motorized system achieved thermal cycling. At the end of a given test, the oxidized samples were characterized using XRD, SEM and EDS.

Example 2A

Figure 6:
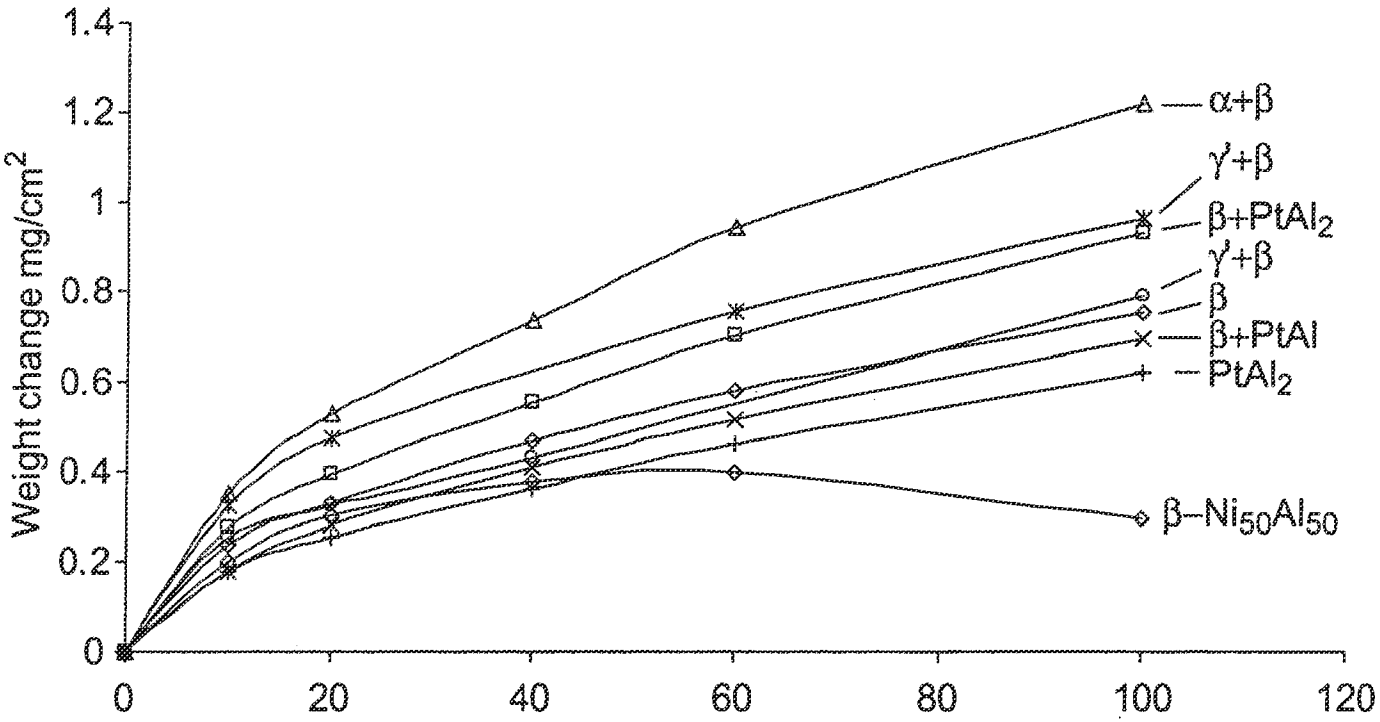
FIG. 6 is a plot showing weight change of Ni—Al—Pt alloys of different phase constitutions after "isothermal" exposure at 1150° C. in still air.
Figure 7A:
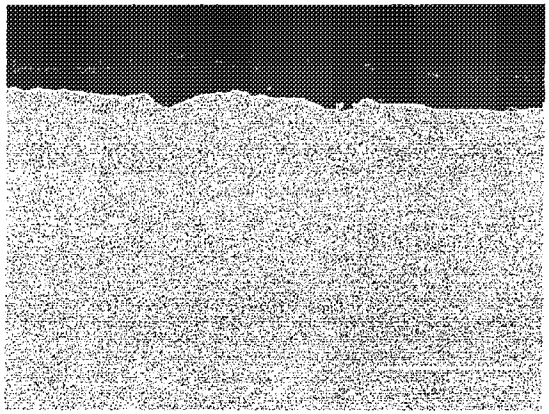
FIG. 7 is a series of cross-sectional images of selected alloys shown in FIG. 6 after 100 h oxidation at 1150° C. in air. The compositions are nominal and in atom percent.
Figure 7B:
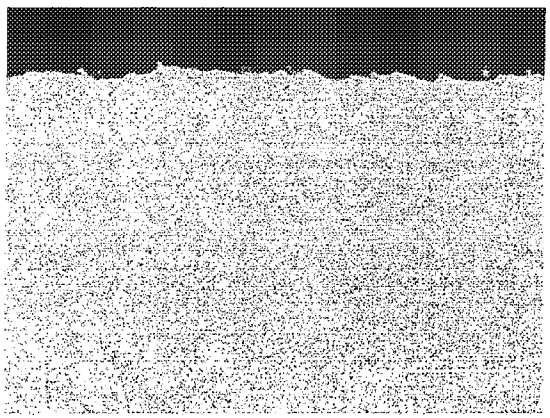
Figure 7C:
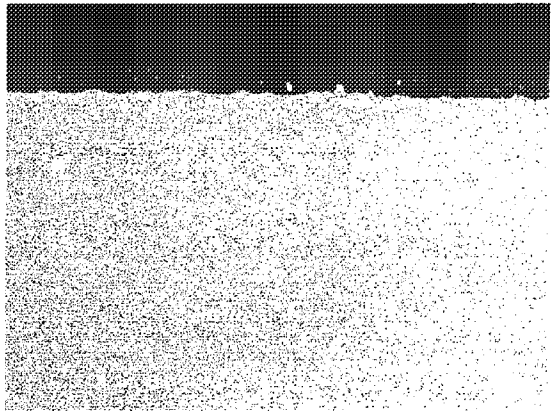
Figure 7D:
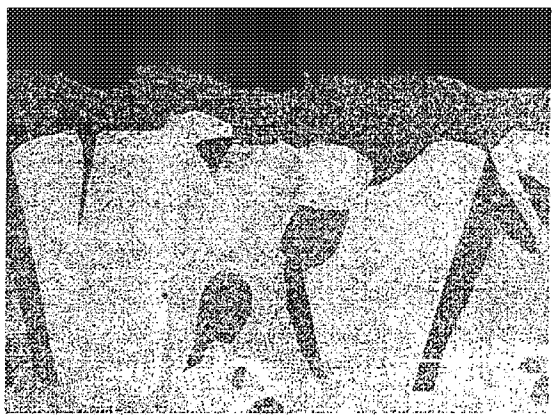

The "isothermal" oxidation behavior at 1150° C. in still air of a range of Ni—Al—Pt alloys of different phase constitutions is shown in FIG. 6. The γ+γ' alloy in this example was the same as alloy 7 in Example 1 above. All of the alloys shown formed an $Al_2O_3$-rich TGO scale layer, as confirmed by XRD. Sample weight changes were measured at room temperature after 20, 40, 60 and 100 hours of exposure. Accordingly, the oxidation test was not truly isothermal. The alloy labeled β in FIG. 6 is β-NiAl containing nominally 50 at % Al and 10 at % Pt. This alloy exhibited positive weight-change kinetics over time and, hence, limited scale spallation. Comparison of the oxidation behavior of binary β-NiAl to that of Pt-modified β-NiAl leads to the conclusion that Pt addition to NiAl-based alloys reduces spallation and enhances TGO scale adhesion. The low weight-change kinetics of the ternary Pt-modified γ+γ' alloy is comparable to those of the β containing alloys, which have higher concentrations of Al.

Binary γ'+γ' alloys exposed under similar conditions were found to undergo significantly higher weight-change kinetics followed by excessive scale spallation. Thus, the addition of Pt to γ+γ' alloys not only improves scale adhesion, but also promotes $Al_2O_3$ scale formation.

Cross-sectional SEM images of selected alloys from the 1150° C. isothermal oxidation test (FIG. 6) are shown in FIG. 7. Each alloy was exposed for 100 hours. The poor scale adhesion of the $Al_2O_3$ TGO scale layer on the binaryl β-NiAl bond coat is clearly evidenced by the gap between the scale layer and the bond coat. Scale adhesion appeared to be quite good for the Pt-modified β-containing alloy bond coats and the Pt modified γ+γ' alloy bond coats. However, in the case of the Pt modified γ+γ' alloy bond coat, the bond coat/TGO scale interface is non-planar, i.e., rumpled. Selective aluminum oxidation caused the subsurface region of this Pt modified γ+γ' alloy (alloy 7) to transform into a continuous γ layer followed by a layer of γ+α. Both layers were found to increase in thickness with increasing time of oxidation. The Pt modified γ+γ' alloy bond coat shown in FIG. 7 is alloy 7 in Example 1 above (Ni-22Al-30Pt).

Figure 8A:
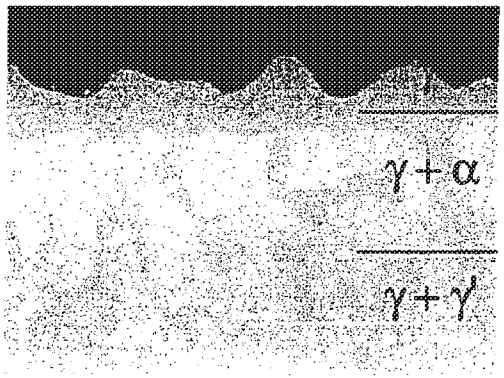
FIG. 8 is a series of cross-sectional images of selected Pt modified γ-Ni+γ'-$Ni_3Al$ alloys after 1000 h isothermal oxidation at 1150° C. in air. All images are the same magnification (×500). The compositions are nominal and in atom percent.
Figure 8B:
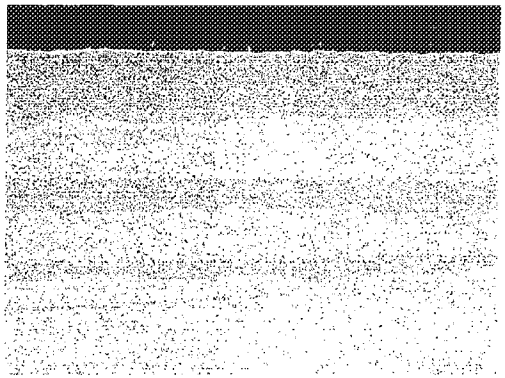
Figure 8C:
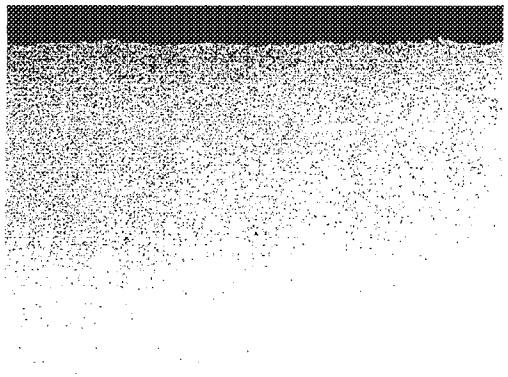

As shown in FIG. 8, a much more planar alloy/scale interface develops if the Ni-22Al-30Pt alloy is modified with 0.5 at. % (1 wt. %) hathium, such that the alloy composition is Ni-22Al-30Pt-0.5Hf, or if the platinum content in the alloy is reduced. In addition, the alloys having a much more planar alloy/scale interface showed no evidence of forming an intermediate layer of γ+α for the times studied (i.e. up to 1000 hours). A comparison of the images in FIG. 8 shows that further benefit of Hf addition is to significantly decrease the thickness of the $Al_2O_3$ scale that develops on the γ+γ' alloys during oxidation.

Example 2B

Figure 9:
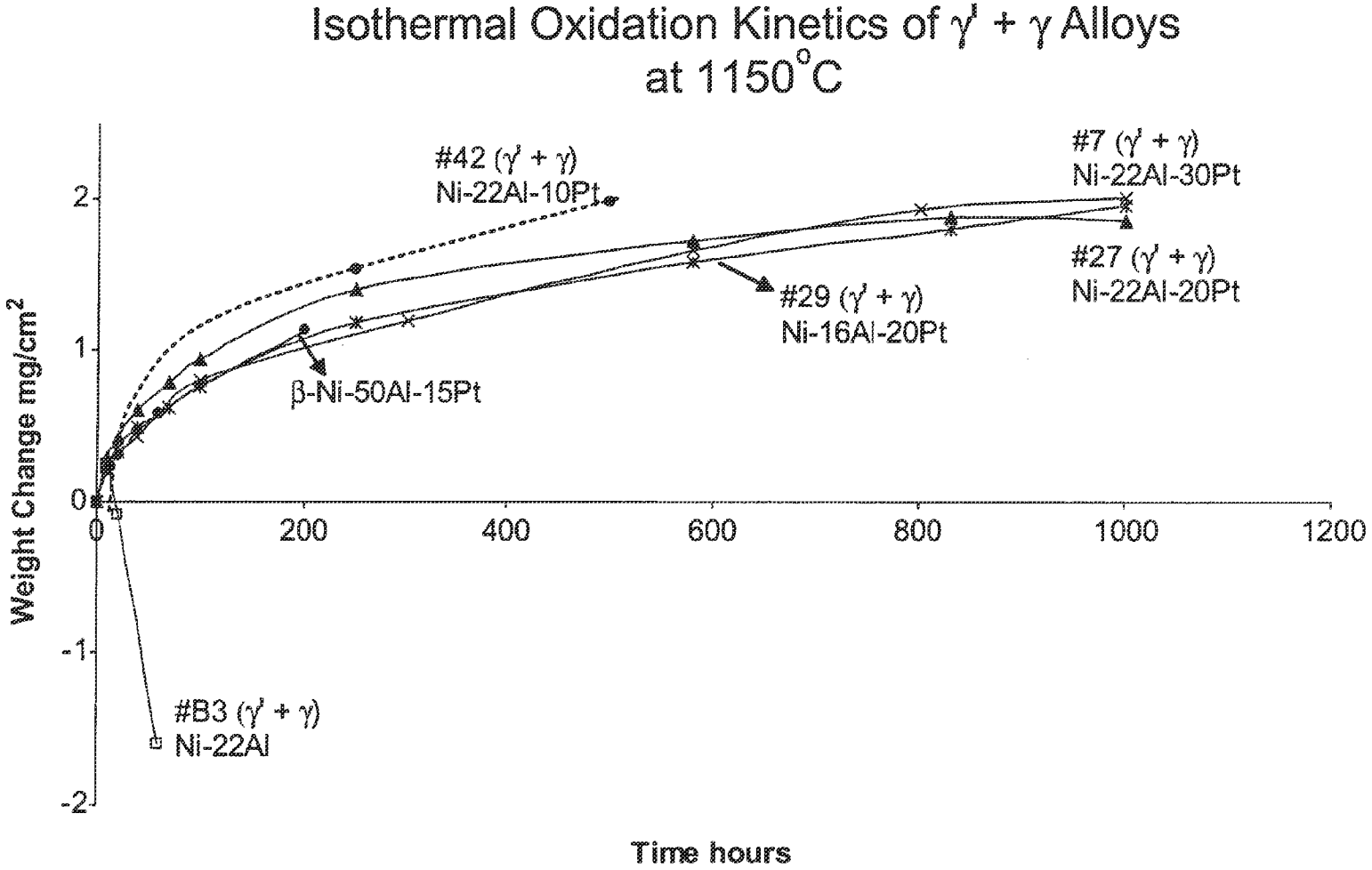
FIG. 9 is a plot showing the cyclic oxidation kinetics at 1150° C. in air of various Pt modified γ-Ni+γ'-$Ni_3Al$ alloys, γ-Ni+γ'-$Ni_3Al$ alloys without Pt, and Pt-modified β-NiAl alloys.
Figure 10A:
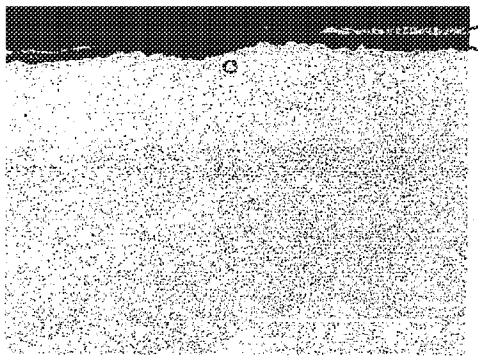
FIG. 10 is a series of cross-sectional images of selected Pt modified, and Pt and Hf modified, γ-Ni+γ'-$Ni_3Al$ alloys, and γ-Ni+γ'-$Ni_3Al$ alloys without Pt following isothermal oxidation at 1150° C. in air.
Figure 10B:
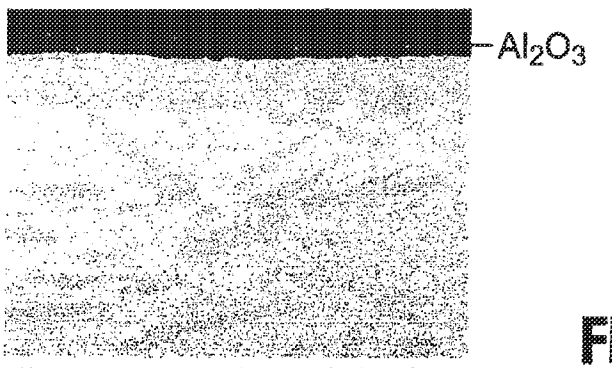
Figure 10C:
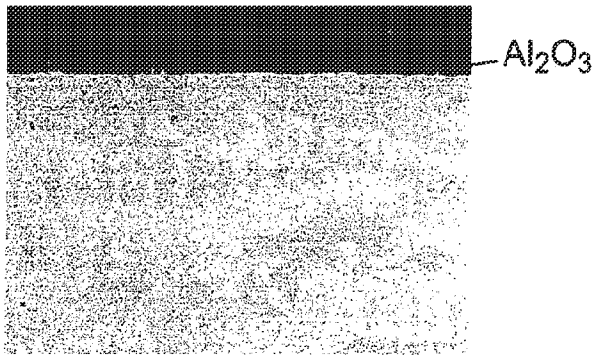
Figure 10D:
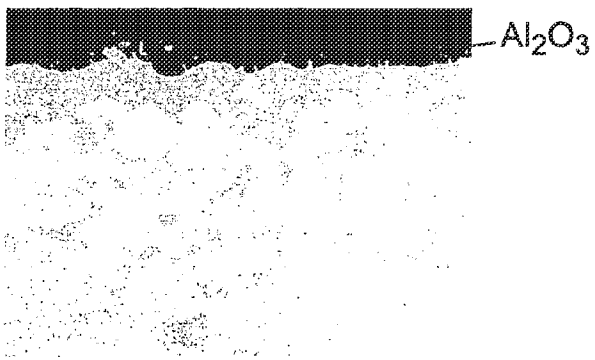

Alloy samples from Example 1 were isothermally and cyclically oxidized at 1150° C. The plot in FIG. 9 shows that a Pt-free γ+γ' alloy (#B3: Ni-22 at. % Al) has very poor cyclic oxidation resistance; whereas, adding 10-30 at. % Pt to this alloy (i.e., keeping the Al content constant at 22 at. % and thus having γ' as the principal phase) significantly improves cyclic oxidation resistance. In the case of alloy #29, it is further shown that the cyclic oxidation resistance is still very good even if the Al content is lowered from 22 to 16 at. % and the Pt content is kept at 20 at. % (i.e. γ is the principal phase).

FIG. 10 shows cross-sectional images of the isothermally oxidized alloys of Example 1. The addition of 10-30 at % Pt to a Ni-22 at % Al promotes the exclusive formation of a continuous and adherent $Al_2O_3$ scale. As indicated, the binary Ni-22 at. % Al alloy B3 forms a poorly adherent scale that contains an out layer of the spinal phase $NiO.Al_2O_3$.

Example 2C

Figure 11:
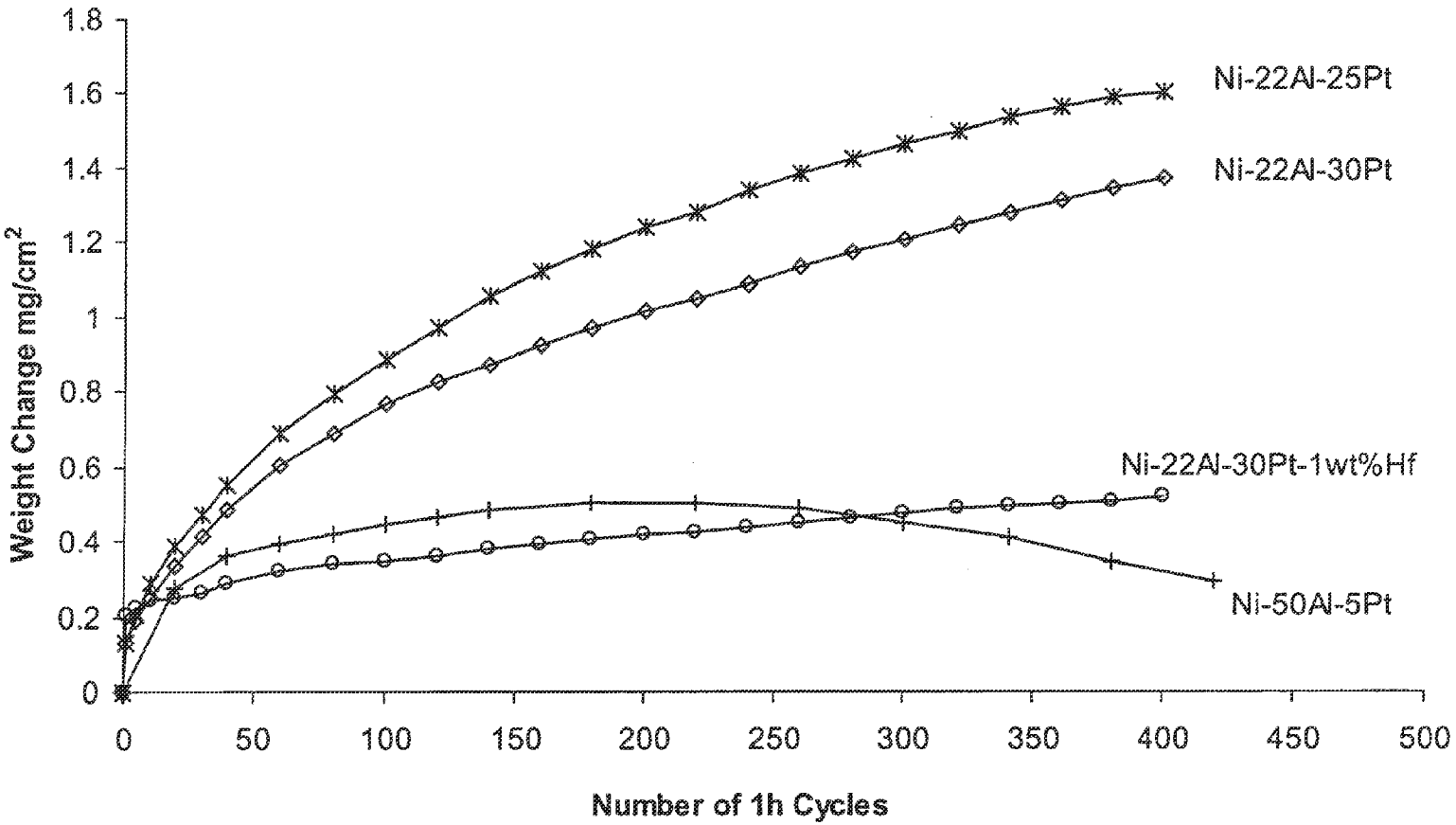
FIG. 11 is a plot comparing the cyclic oxidation kinetics of Pt-modified β-NiAl, γNi+γ'-$Ni_3Al$, and Hf-modified γ-Ni+γ'-$Ni_3Al$ at 1150° C. in air.

FIG. 11 compares the 1150° C. cyclic oxidation kinetics of bulk alloys of the following Pt-modified alloys: β-NiAl (50 at. % Al), γ-Ni+γ'-$Ni_3Al$+ (22 at. % Al), and Hf-modified γ-Ni+γ'-$Ni_3Al$+ (22 at. % Al). Each thermal cycle consisted of one hour at 1150° C. in air followed by 15 minutes in air at about 120° C. It is seen that the 13 alloy (based on the commonly used bond coat composition) underwent weight loss, which is indicative of oxide-scale spallation, while the better performing γ+γ' alloys did not show notable evidence of scale spallation. The performance of the Hf-modified alloy is particularly superior, showing minimal weight gain and, therefore, an exceptionally slow rate of oxide-scale growth. It is noteworthy that the beneficial effect of hafnium was observed even at an alloying content of 2 wt. %. Such a high hafnium content would be highly detrimental to the oxidation resistance of a β-based coating, which requires no greater than about 0.1 wt. % hafnium for a beneficial effect. From a practical standpoint, staying below this low maximum is very difficult to achieve and therefore hafnium is generally not intentionally added to b-based coatings. The γ+γ' bond coating compositions being proposed in this application will easily allow for the addition of hafnium and thus for optimization for protective scale formation.

Example 2D

Figure 12:
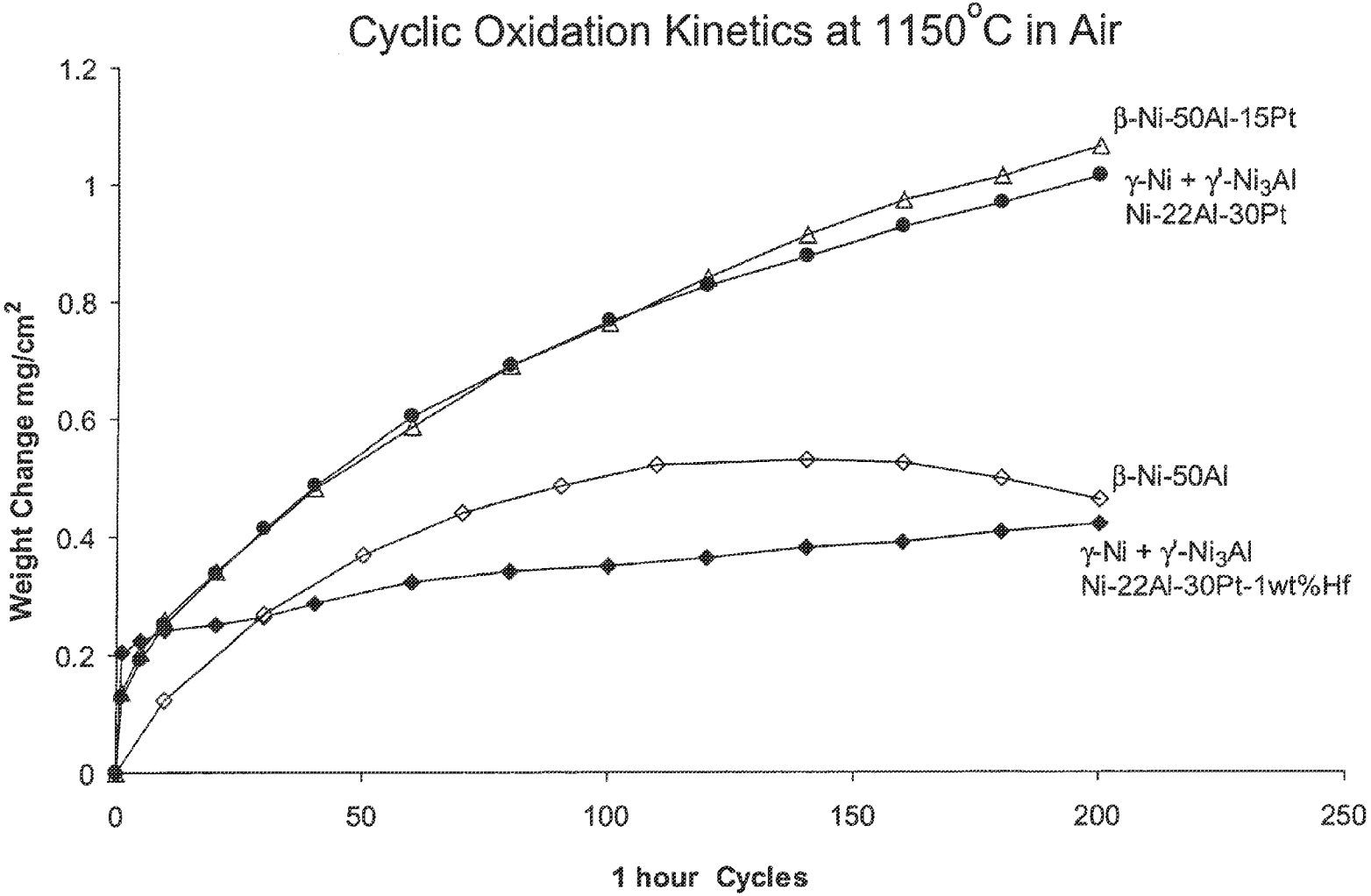
FIG. 12 is a plot comparing the cyclic oxidation kinetics of Pt-modified β-NiAl, γNi+γ'-$Ni_3Al$ alloys and those a Pt-modified β-NiAl alloy at 1150° C. in air.

This example compares the cyclic oxidation kinetics at 1150° C. in air of various alloy compositions. The plot in FIG. 12 shows that the cyclic oxidation kinetics of the Pt-modified γ-Ni+γ'$Ni_3Al$ alloy are comparable to the Pt-modified β-NiAl alloy. The β-NiAl alloy contains 50 at. % Al (i.e., more than double that of the Pt-modified γ-Ni+γ'$Ni_3Al$ alloy) and is representative of alloys used as conventional Pt-modified β-NiAl bond coatings. The plot of FIG. 12 also shows the significant benefit of adding 1 wt. % (~0.5 at. %) Hf to the Pt-modified γ-Ni+γ'$Ni_3Al$ alloy. The rate of $Al_2O_3$ scale growth decreases by almost an order of magnitude with Hf addition.

Example 2E

Figure 13:
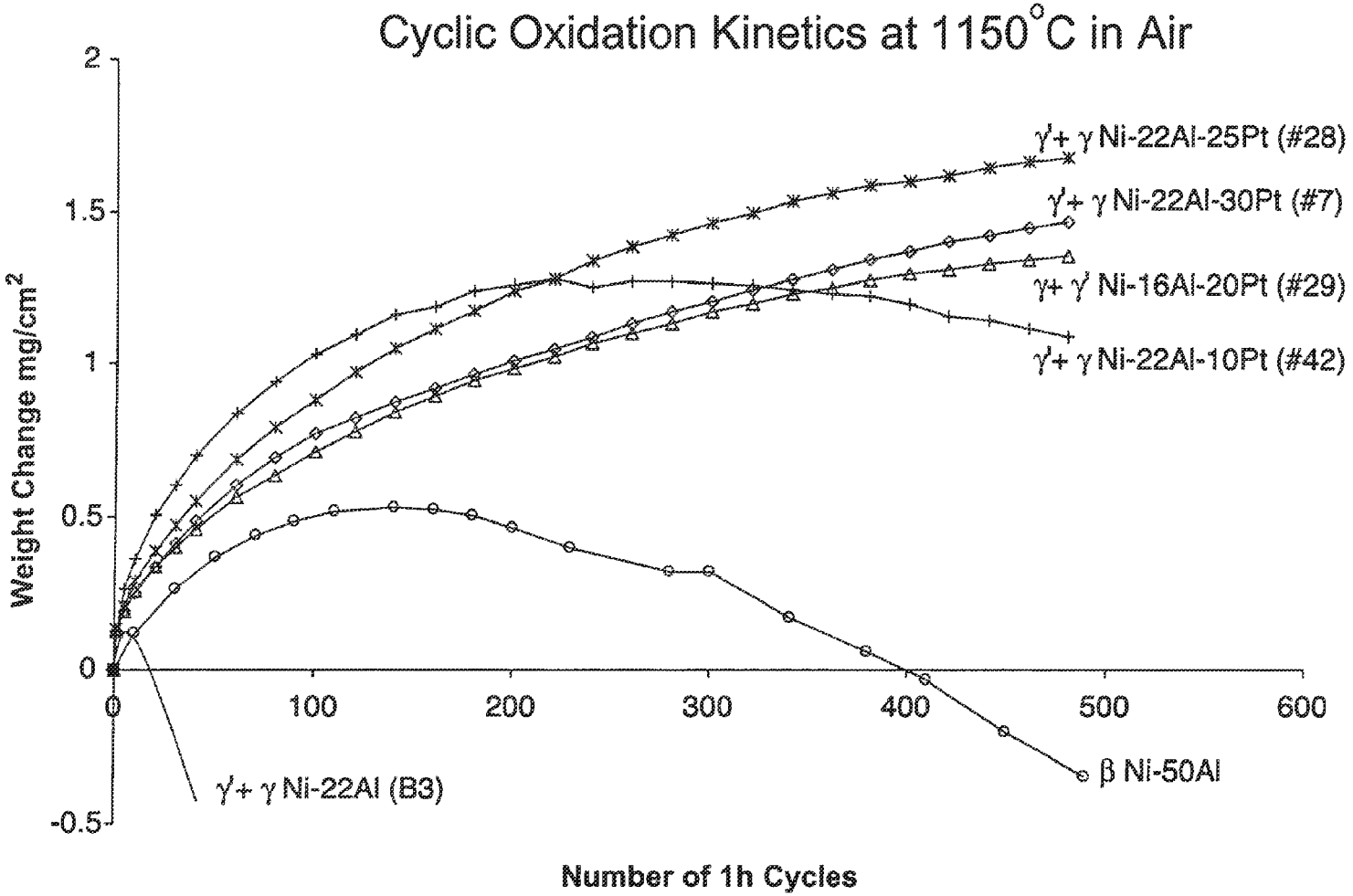
FIG. 13 is a plot comparing the cyclic oxidation kinetics of Pt-modified β-NiAl, γNi+γ'-$Ni_3Al$ alloys of Example 1 and those of a Pt-modified β-NiAl alloy at 1150° C. in air.

This example compares the cyclic oxidation kinetics at 1150° C. in air of various γ+γ' alloy compositions of Example 1. The plot in FIG. 13 shows the cyclic oxidation of various Pt-modified γ-Ni+γ'$Ni_3Al$ alloy from Example 1, together with a binary γ-Ni+γ'$Ni_3Al$ alloy (B3 of Example 1, with 22 at. % Al) and a stoichiometric β-NiAl alloy. It is seen that the alloys containing more than 10 at. % Pt exhibit very protective oxidation behavior, with always a positive rate of weight change and, hence, no measurable scale spallation.

Example 2F

Figure 14:
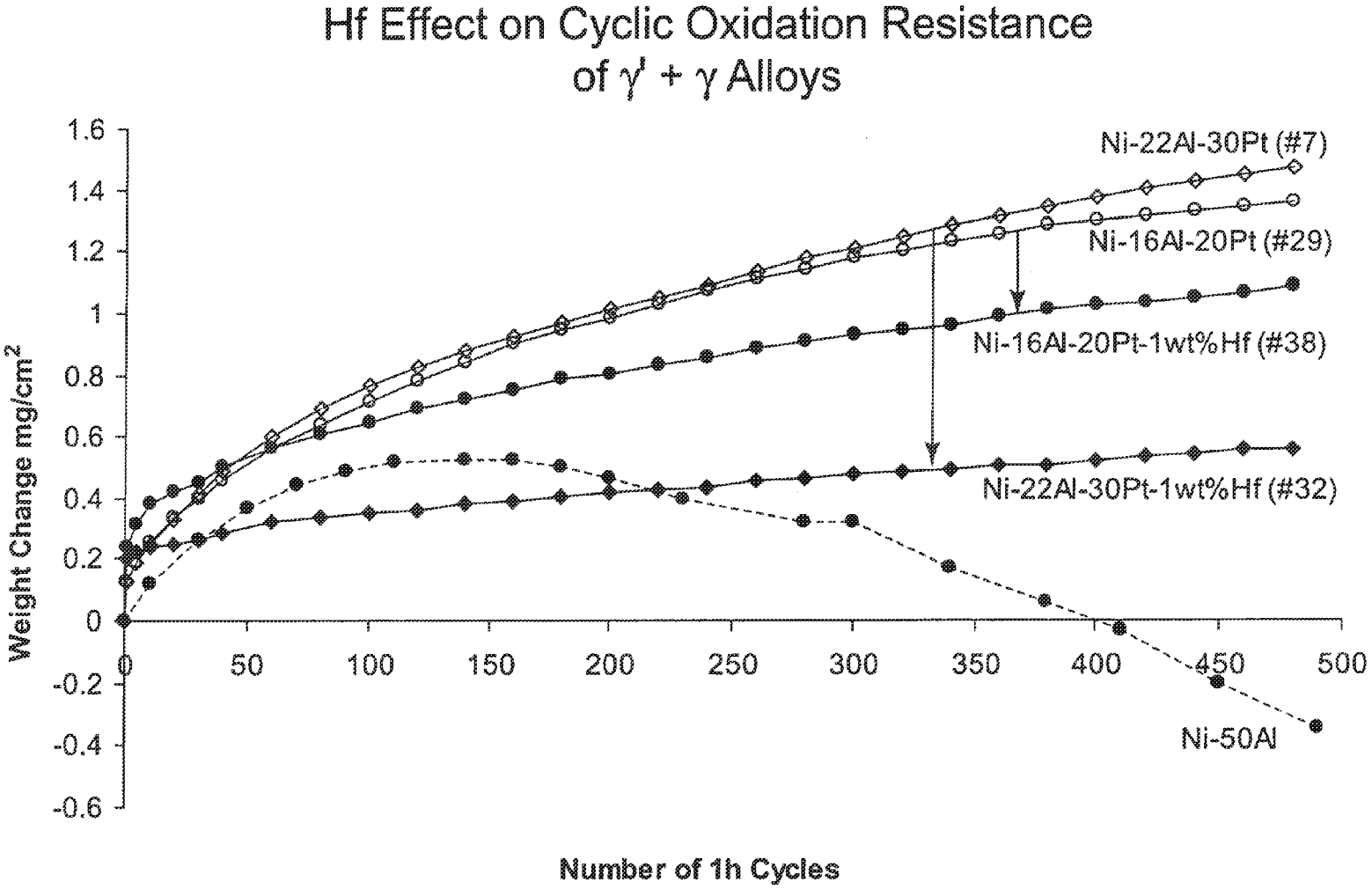
FIG. 14 is a plot showing the effect of Hf modification on the cyclic oxidation kinetics of Pt-modified β-NiAl, γNi+γ'-$Ni_3Al$ alloys of Example 1.
Figure 15A:
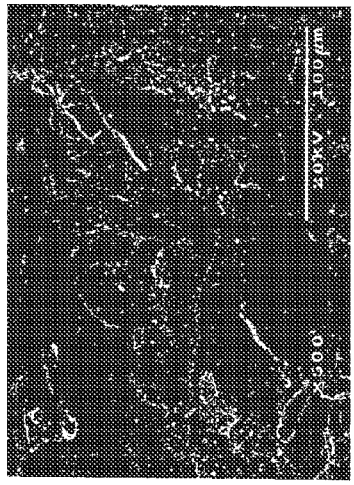
FIG. 15 is a series of surface and cross-sectional images illustrating the effect of Hf modification on selected Pt-modified β-NiAl, γNi+γ'-$Ni_3Al$ alloys of Example 1 and FIG. 14.
Figure 15B:
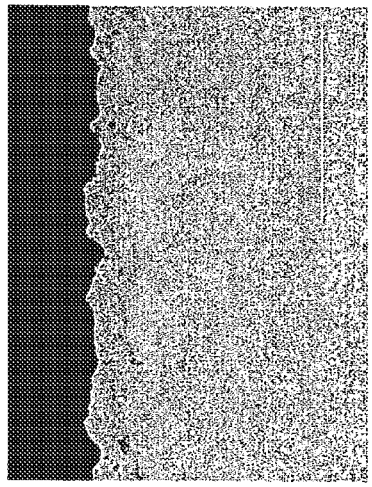
Figure 15C:
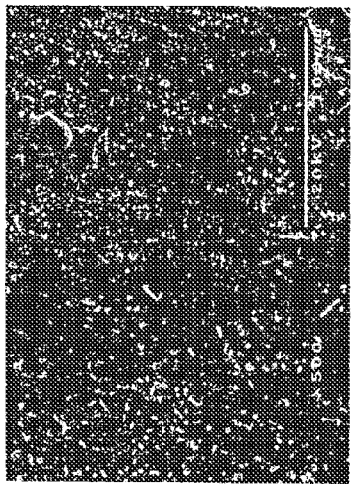
Figure 15D:
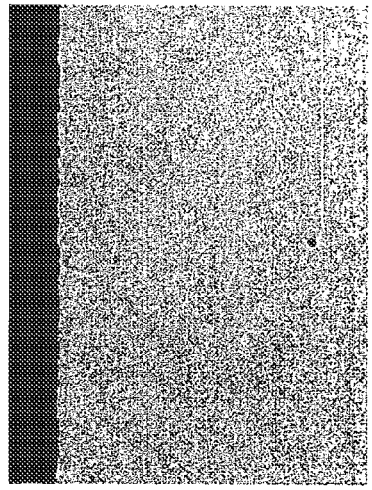

The plot of FIG. 14 shows the beneficial effect of Hf addition for improving the oxidation resistance of various Pt-modified γ-Ni+γ'$Ni_3Al$ alloys from Example 1, together with a stoichiometric β-NiAl alloy. Closer inspection shows that the beneficial effect is greatest when γ' is the principal phase in the alloy (alloy 32, which is alloy 7 with 1 wt % Hf), compared to when γ is the principal phase in the alloy (alloy 38, which is alloy 29 with 1 wt % Hf). This is likely because Hf is much more soluble in γ' than in γ, thus the hafnium is more uniformly distributed in the γ'-based alloy.

As shown in the surface and cross-sectional images of FIG. 15, scale adhesion is much improved with the addition of 1 wt. % (~0.5 at. %) Hf to the Ni-22 at. % Al-30 at. % Pt alloy. A test including 1000 thermal cycles, with each cycle consisting of 1 h at 1150° C.+15 min at ~120° C., is considered a long-term test.

Example 2G

Figure 16:
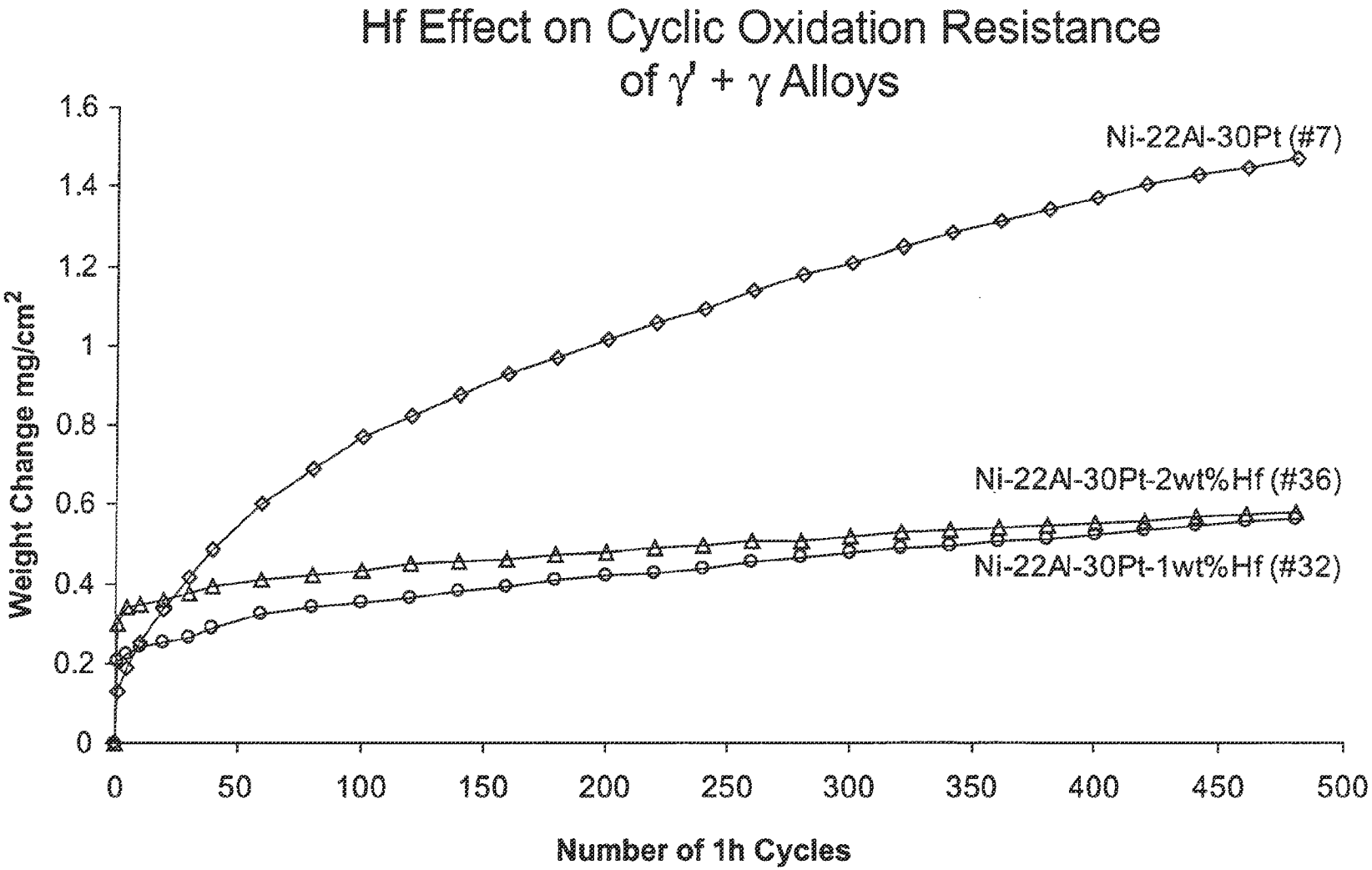
FIG. 16 is a plot showing the effect of Hf modification on the cyclic oxidation kinetics of Pt-modified β-NiAl, γNi+γ'-$Ni_3Al$ alloys of Example 1.

The plot of FIG. 16 shows that the cyclic oxidation resistance of the Pt-modified γ-Ni+γ'$Ni_3Al$ alloy from Example 1 (where γ' is the principal phase) can be improved with the addition of even 2 wt. % (~1 at. %) hafnium (alloy 36, which is alloy 7 with 2 at % Hf). In the context of the currently-used β-NiAl-based coatings, such a high hafnium content would never be used, as it would be detrimental to oxidation resistance.

The cross-sectional images in FIG. 17 show that 1 and 2 wt. % Hf addition to the high-Pt alloy #7 causes a significant reduction in the extent of rumpling at the alloy/scale interface. Rumpling is a progressive roughening of the surface and should be avoided to maintain optimum oxidation resistance.

Example 3

Interdiffusion couples were made by hot isostatic pressing alloy coupons at 1150° C. for 1 hour. Subsequent interdiffusion annealing was carried out at either 1100° C. or 1150° C. for up to 50 h in a flowing argon atmosphere. The diffusion couples were quenched in water at the end of a given interdiffusion anneal. The same characterization techniques discussed above were used to analyze the interdiffusion behavior in the Ni—Al—Pt system.

The effects of Pt on the interdiffusion of Al in Pt modified γ-Ni+γ'-$Ni_3Al$ alloys were studied at 1150° C. It was found that, with sufficient Pt content (e.g., greater than about 15 at. %) the chemical activity of Al in the γ+γ' alloy containing 22 at % Al is decreased to the extent that there is uphill diffusion of Al from the "substrate" (containing ~13-19 at. % Al) to the γ+γ' coating composition.

A representative example is shown in FIG. 18 for the case of a γ+γ' (Ni-22Al-30Pt)/γ+γ' (Ni-19Al) couple after 50 h interdiffusion at 1150° C.

Figure 19B:
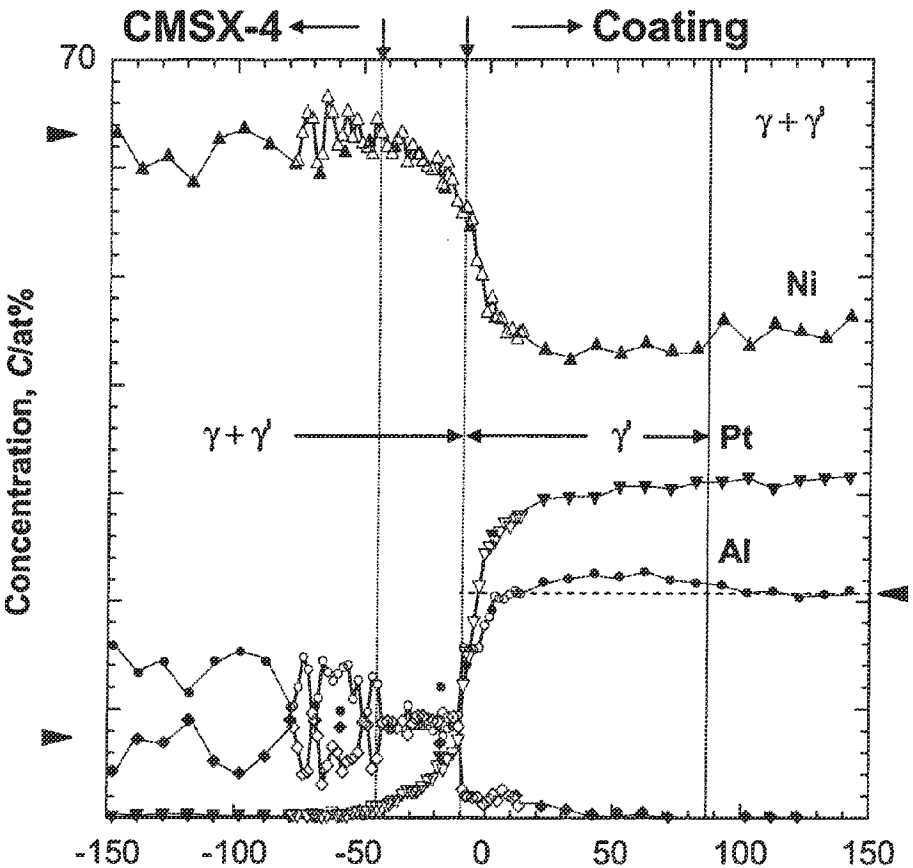
FIG. 19 is an illustration of microstructure and composition profiles through a γ-Ni+γ'-$Ni_3Al$ alloy composition (Ni-22Al-30Pt)/CMSX-4 couple after 50 h interdiffusion at 1150° C.
Figure 19A:
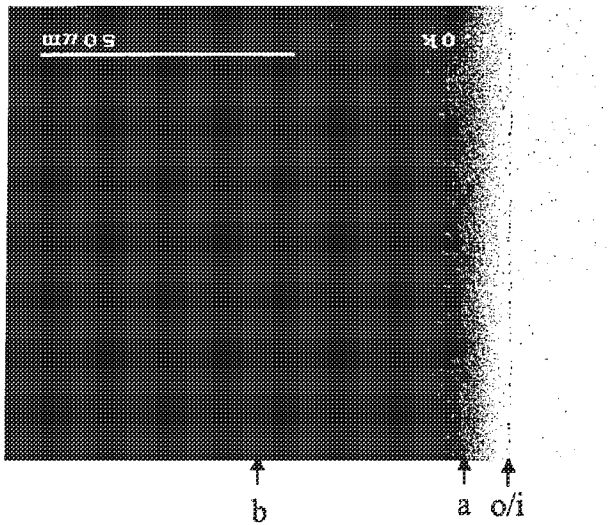

A second representative example is shown in FIG. 19 for the case of a γ'+γ (Ni-22Al-30Pt)/CMSX-4 couple after 50 h interdiffusion at 1150° C.

In each of these examples the enrichment of aluminum in the Al-rich, γ+γ' "coating" side of the couple is clearly evident in the composition profiles shown in FIGS. 18-19. The finding of uphill aluminum diffusion is significant, as it shows that Pt modified γ-Ni+γ'-$Ni_3Al$ alloy coatings can be formulated that will exhibit aluminum replenishment or even enrichment owing to Al diffusion from the substrate to the coating. This latter behavior is in direct contrast to what is observed in β-NiAl containing coatings.

A number of embodiments of the invention have been described. Nevertheless, it will be understood that various modifications may be made without departing from the spirit and scope of the invention. Accordingly, other embodiments are within the scope of the following claims.

The invention claimed is:

1. An alloy comprising:

about 10 at % to about 30 at % of a Pt-group metal;

less than about 23 at % Al;

about 0.5 at % to about 2 at % of at least one reactive element selected from Hf, Y, La, Ce and Zr, and combinations thereof;

a superalloy substrate constituent selected from the group consisting of Cr, Co, Mo, Ta, Re and combinations thereof; and Ni;

wherein the Pt-group metal, Al, the reactive element and the superalloy substrate constituent are present in the alloy in a concentration to the extent that the alloy has a solely γ'-$Ni_3Al$ phase constitution.

2. The alloy of claim 1, wherein the Pt-group metal is selected from Pt, Pd, Ir, Rh and Ru, and combinations thereof.

3. The alloy of claim 1, wherein the Pt-group metal is Pt.

4. The alloy of claim 1, wherein the reactive element is Hf.

5. The alloy of claim 4, wherein the Hf is present is present in the alloy at a concentration of about 0.5 at % to about 1 at %.

6. The alloy of claim 1, wherein the Al is present at about 10 at % to about 22 at %.

7. The alloy of claim 1, wherein the Pt-group metal is Ir.

8. A Ni—Al—Pt—Hf alloy comprising:

less than about 23 at % Al;

about 10 at % to about 30 at % of a Pt-group metal;

about 0.5 at % to about 2 at % Hf;

a superalloy substrate constituent selected from the group consisting of Cr, Co, Mo, Ta, Re and combinations thereof; and Ni;

wherein the Pt-group metal, Al, the Hf and the superalloy substrate constituent are present in the alloy in a concentration to the extent that the alloy has a solely γ'-$Ni_3Al$ phase constitution.

9. The alloy of claim 8, wherein the Pt-group metal is Pt.

10. The alloy of claim 8, wherein the Hf is present in the alloy at a concentration of about 0.5 at % to about 1 at %.

11. The alloy of claim 8, wherein the alloy comprises about 10 at % to about 22 at % Al and about 15 at % to about 30 at % of Pt.

12. A coating on a superalloy substrate, wherein the coating comprises:

about 10 at % to about 30 at % of a Pt-group metal;

less than about 23 at % Al;

about 0.5 at % to about 2 at % of a reactive element selected from Hf, Y, La, Ce, Zr and combinations thereof;

a superalloy substrate constituent selected from the group consisting of Cr, Co, Mo, Ta, Re and combinations thereof; and Ni, and wherein the Pt-group metal, Al, the reactive element and the superalloy substrate constituent are present in the coating in a concentration to the extent that the coating has a solely γ'-$Ni_3Al$ phase constitution.

13. The coating of claim 12, wherein the Pt-group metal is selected from Pt, Pd, Ir, Rh and Ru, and combinations thereof.

14. The coating of claim 12, wherein the Pt-group metal is Pt.

15. The coating of claim 12, wherein the Pt-group metal is Ir.

16. The coating of claim 12, wherein the reactive element is Hf.

17. A thermal barrier coated article comprising:

(a) a superalloy substrate;

(b) a bond coat on the substrate, wherein the bond coat comprises:

about 10 at % to about 30 at % Pt, less than about 23 at % Al, about 0.5 at % to about 2 at % of a reactive element selected from Hf, Y, La, Ce, Zr, and combinations thereof, a superalloy substrate constituent selected from the group consisting of Cr, Co, Mo, Ta, Re and combinations thereof, and Ni, wherein the Pt, Al, the reactive element and the superalloy substrate constituent are present in the bond coat in a concentration such that the bond coat has a solely γ'-$Ni_3Al$ phase constitution.

18. The article of claim 17, further comprising an adherent layer of oxide on the bond coat.

19. The article of claim 18, further comprising a ceramic coating on the adherent layer of oxide.

20. The article of claim 17, wherein the reactive metal is Hf.

21. The article of claim 17, wherein the bond coat has a thickness of about 5 μm to about 100 μm.

22. The article of claim 17, wherein the bond coat has a thickness of about 5 μm to about 50 μm.

23. The article of claim 17, wherein the bond coat has a thickness of about 10 μm to about 50 μm.

24. A thermal barrier coated article comprising:

(a) a superalloy substrate;

(b) a bond coat on the substrate, wherein the bond coat comprises an alloy comprising:

about 10 at % to about 30 at % of a Pt-group metal, less than about 23 at % Al, about 0.5 at % to about 2 at % of Hf, a superalloy substrate constituent selected from the group consisting of Cr, Co, Mo, Ta, Re and combinations thereof, and Ni, wherein the Pt-group metal, Al, the Hf and the superalloy substrate constituent are present in the bond coat in a concentration such that the alloy has a solely $\gamma'$-$Ni_3Al$ phase constitution;

(c) an adherent layer of oxide on the bond coat; and (d) a ceramic coating on the adherent layer of oxide.

25. The article of claim 24, wherein the bond coat comprises about 0.5 at % to about 1 at % Hf.

* * * * *